US010702115B2

(12) United States Patent
Smith

(10) Patent No.: US 10,702,115 B2
(45) **Date of Patent: *Jul. 7, 2020**

(54) SURFACE TREATING MACHINE WITH AUTOMATIC DRIVE

(71) Applicant: Pogo International Limited, Hong Kong (CN)

(72) Inventor: Yale Merret Smith, San Rafael, CA (US)

(73) Assignee: Pogo International Limited, Wanchai (HK)

( * ) Notice: Subject to any disclaimer, the term of this patent is extended or adjusted under 35 U.S.C. 154(b) by 433 days.

This patent is subject to a terminal disclaimer.

(21) Appl. No.: 15/406,326

(22) Filed: Jan. 13, 2017

(65) Prior Publication Data

US 2017/0143177 A1 May 25, 2017

Related U.S. Application Data

(63) Continuation-in-part of application No. 14/868,216, filed on Sep. 28, 2015, now Pat. No. 10,130,229.

(51) Int. Cl.

| | |
|---|---|
| ***A47L 11/12*** | (2006.01) |
| ***A47L 11/28*** | (2006.01) |
| ***A47L 11/284*** | (2006.01) |
| ***A47L 11/06*** | (2006.01) |
| ***A47L 13/29*** | (2006.01) |

(Continued)

(52) U.S. Cl.

CPC ..... *A47L 11/12* (2013.01); *A47L 11/06* (2013.01); *A47L 11/26* (2013.01); *A47L 11/28* (2013.01); *A47L 11/284* (2013.01); *A47L 11/4002* (2013.01); *A47L 11/4005* (2013.01);

(Continued)

(58) Field of Classification Search

CPC ..... A47L 11/10; A47L 11/12; A47L 11/28; A47L 11/284; A47L 11/40; A47L 11/4002; A47L 11/4005; A47L 11/4011; A47L 11/4036; A47L 11/4063; A47L 11/4066; A47L 11/4069; A47L 11/4075; B24B 23/00; B24B 23/04

USPC ..... 15/49.1, 50.1, 50.2, 52.2, 98; 451/350, 451/351, 356, 357

See application file for complete search history.

(56) References Cited

U.S. PATENT DOCUMENTS 2,370,864 A * 3/1945 Krieger ..... B24B 23/04 451/164
2,885,833 A * 5/1959 Neff ..... B24B 23/04 451/356

(Continued)

FOREIGN PATENT DOCUMENTS

CH 274773 * 4/1951
EP 128277 * 3/1984

(Continued)

*Primary Examiner* — Mark Spisich
(74) *Attorney, Agent, or Firm* — David E. Lovejoy

(57) ABSTRACT

The present invention is a machine for treating a surface lying in an XY plane. The machine includes a body having a body plate, a cleaning plate, a cleaning pad, a drive assembly and an attachment assembly. The cleaning plate is located between the body plate and the XY plane. The drive assembly is connected to the cleaning plate to drive the cleaning plate with a cleaning vibration in an oscillating pattern parallel to the XY plane and producing a drive force for driving the machine over the XY-plane.

16 Claims, 19 Drawing Sheets

(51) Int. Cl.
*A47L 11/26* (2006.01)
*A47L 11/40* (2006.01)
*B08B 1/00* (2006.01)

(52) U.S. Cl.
CPC ..... *A47L 11/4036* (2013.01); *A47L 13/29* (2013.01); *B08B 1/00* (2013.01)

(56) References Cited

U.S. PATENT DOCUMENTS 2,893,175 A * 7/1959 Bruck ..... B24B 23/04 451/356
3,251,087 A * 5/1966 Platt, Jr. ..... A47L 11/38 15/98
3,416,177 A * 12/1968 Young ..... A47L 11/12 15/98
3,445,877 A * 5/1969 Stout ..... A47L 11/12 15/22.1
3,655,444 A * 4/1972 Young ..... A47L 11/12 134/6
3,972,088 A * 8/1976 Thomas ..... A47L 11/12 15/4
4,321,095 A * 3/1982 Argo ..... A47L 11/284 134/6
4,686,797 A * 8/1987 Hoffman ..... B24B 23/043 15/22.1
5,084,938 A * 2/1992 Knestele ..... A47L 11/34 15/98
7,104,873 B1 * 9/2006 Borinato ..... B24B 23/03 451/121
7,565,712 B2 * 7/2009 Long ..... A47L 11/065 15/22.2
2003/0167585 A1 * 9/2003 Chen ..... B24B 23/04 15/97.1
2004/0040579 A1 * 3/2004 Smith ..... A47L 11/12 134/6
2004/0107522 A1 * 6/2004 Paas ..... A47L 11/125 15/98
2004/0187238 A1 * 9/2004 Young ..... A47L 11/12 15/98
2006/0059640 A1 * 3/2006 Hornsby ..... A47L 11/12 15/98
2014/0259478 A1 * 9/2014 Conrad ..... A47L 11/4083 15/98
2014/0259510 A1 * 9/2014 Conrad ..... A47L 13/225 15/319
2015/0173569 A1 * 6/2015 Griggs ..... A47K 7/02 601/46

FOREIGN PATENT DOCUMENTS

JP 2004-105592 * 4/2004
JP 2009-189534 * 8/2009

* cited by examiner

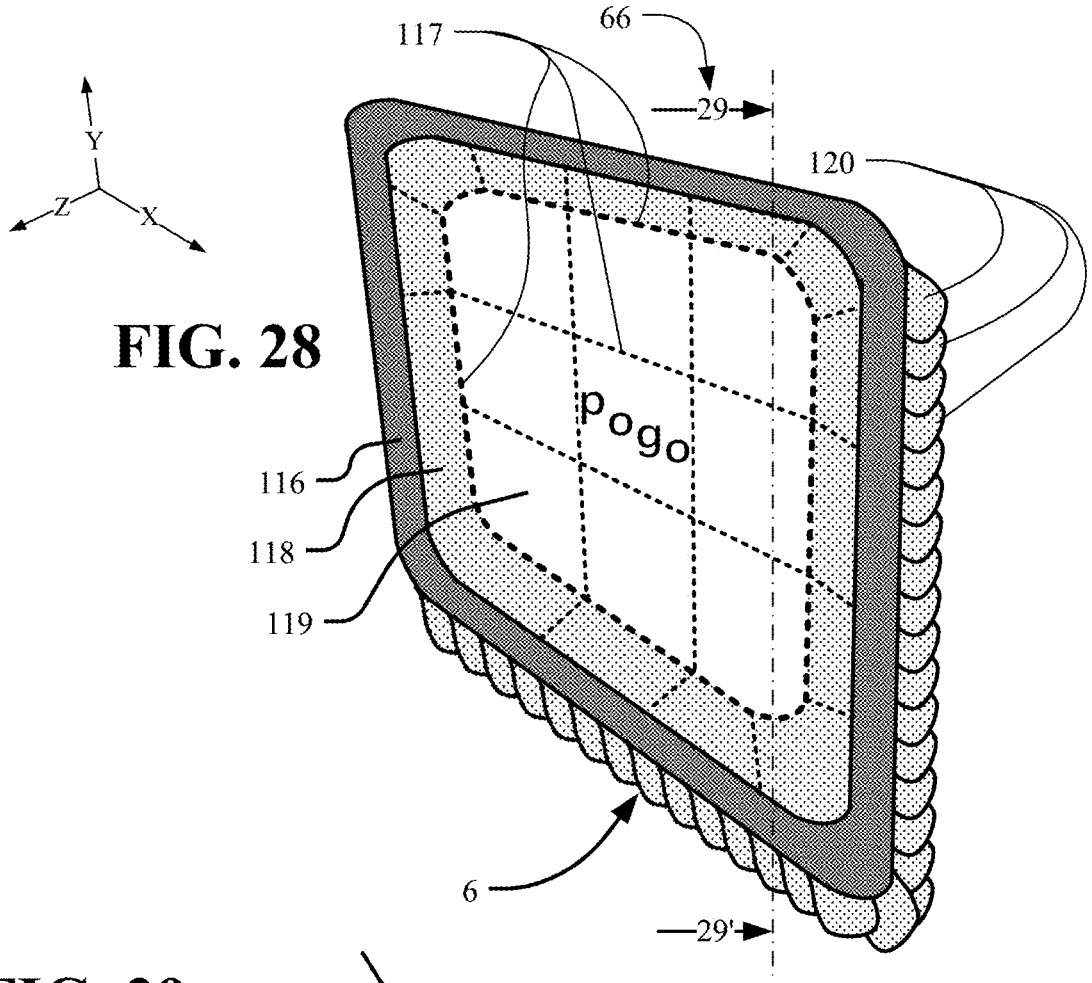
FIG. 28
FIG. 29
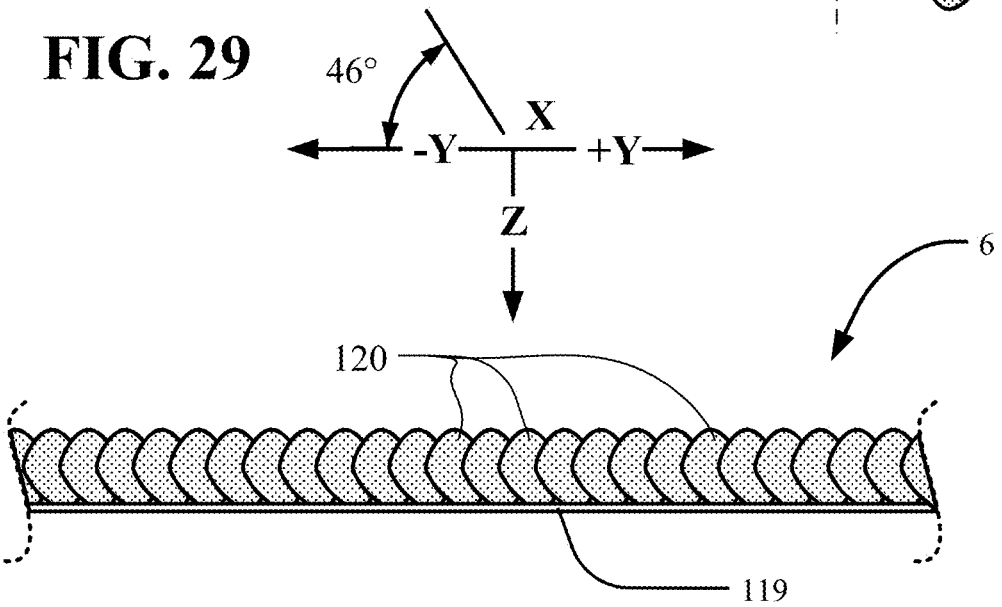

FIG. 43
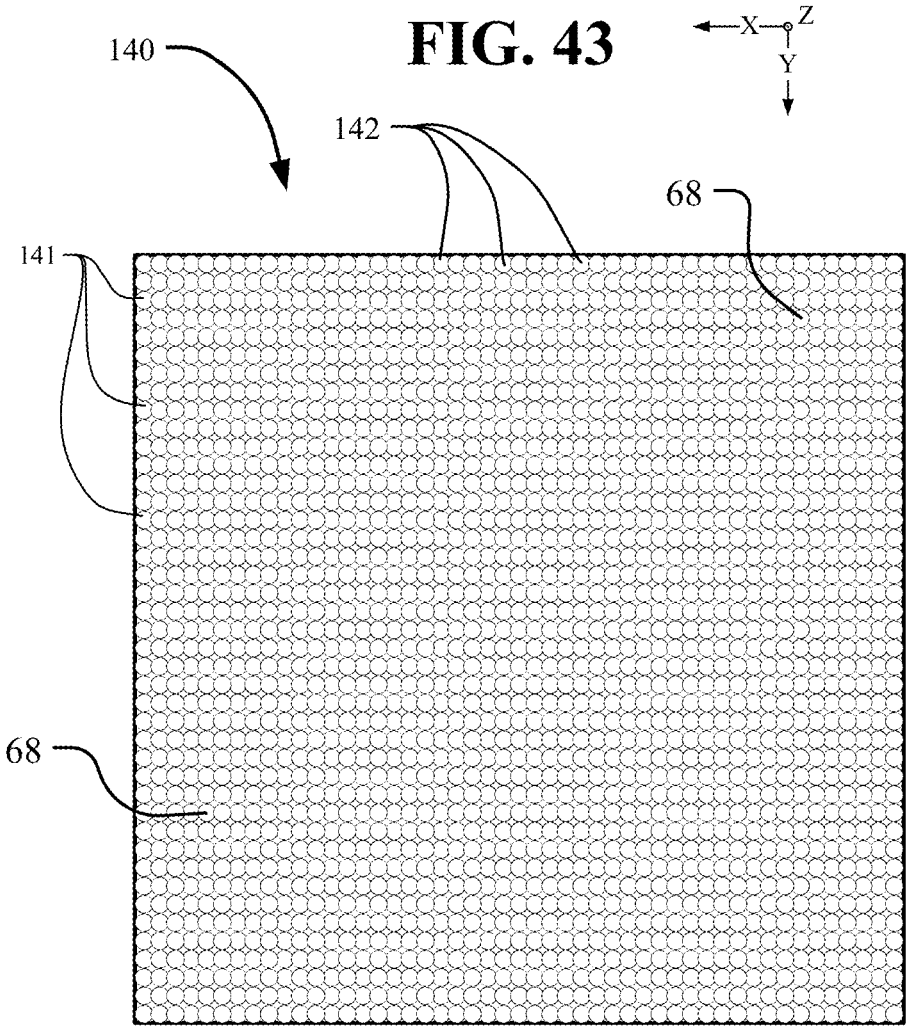
FIG. 44
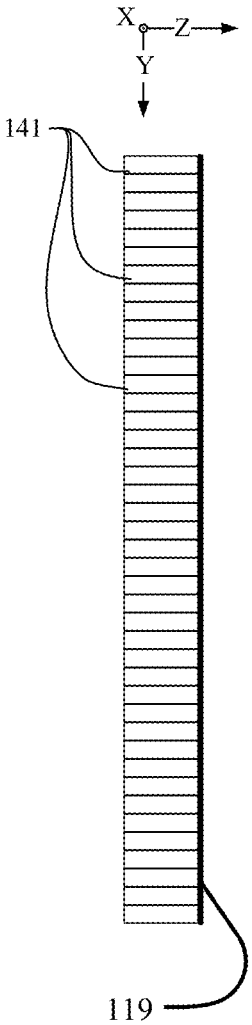
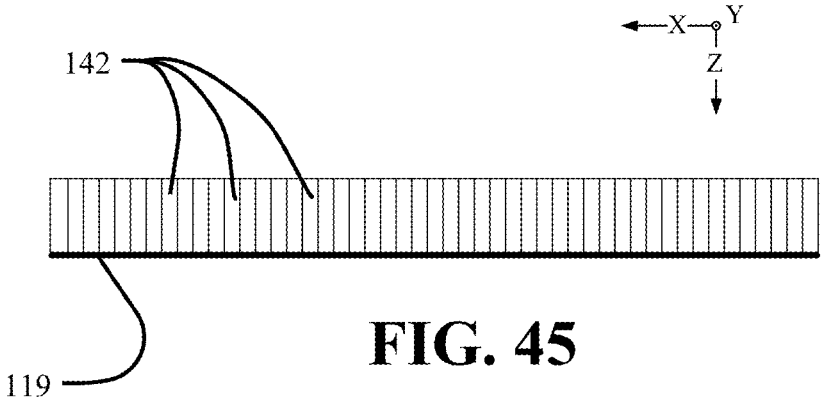
FIG. 45

SURFACE TREATING MACHINE WITH AUTOMATIC DRIVE

This application is a continuation in part of application Ser. No. 14/868,216 filed Sep. 28, 2015 and now U.S. Pat. No. 10,130,229 issued Nov. 20, 2018.

BACKGROUND OF THE INVENTION

This invention relates to a machine for cleaning or otherwise treating floors and other work surfaces formed of carpet, tile, wood and other materials. The most efficient and effective surface treatments employ a vibration, "scrubbing", motion to loosen materials on the work surface and within any permeable material, such as a rug or other fabric, under or part of the work surface. On floors and other work surfaces, a machine typically uses a cleaning towel, "pad", in combination with a solvent, including water or steam, and/or a cleaning agent. Removal of some stains or other material is sometimes better achieved without a solvent or cleaning agent. When the cleaning towel scrubs the floor and becomes dirty, the towel is replaced with a clean one. The machine is easier to use when automatic drive forces are generated in or by the machine.

Important attributes of surface treating machines are cleaning effectiveness, ease of use, convenience, stability, light weight, low machine wear, long life and ease of maintenance. These attributes are import for machines used by professionals in heavy duty environments or used by other consumers in home or other light duty environments.

Cleaning effectiveness requires that machines include a small oscillation that creates a local vibration in a cleaning plate and cleaning pad to impart a "scrubbing" movement to the surface being treated. For cleaning floors, the local vibration is preferably in a range of several millimeters. Cleaning effectiveness and convenience frequently requires that the shape of the cleaning plate be rectangular so as to be readily used along straight edges and easily moved into rectangular corners. In order to satisfy these attributes, machines with round bottom plates are often undesirable.

Ease of use and convenience require stability, appropriate size and weight and ease of operator control. Designs that position the motor and drive assembly high above the cleaning plate are undesirable since such configurations tend to excessively accentuate vertical instability. Vertical instability results in unwanted oscillation of the cleaning plate up and down in a mode that is in and out of the plane of the work surface. The plane of the work surface is referred to, for example, as the floor surface plane or the XY-plane. Excessive vertical instability is distinguished from horizontal oscillations providing local vibration to impart a "scrubbing" movement to the cleaning plate. The horizontal oscillations are parallel to the plane of the work surface, that is, parallel to the XY-plane. Vertical instability is additionally undesirable because it uses excessive amounts of energy, reduces the energy efficiency of the machine and causes increased wear on the motor, the drive shafts, the drivers and the drive bushings. The increased wear increases maintenance and decreases the life of the machine. User fatigue is dramatic when unwanted vertical oscillations occur.

High energy efficiency is an important attribute. For machines powered by an AC electrical service through an AC-to-DC converter or powered by a battery, the size and cost of the motor is a function of the energy requirements needed to drive the transmission and the cleaning plate. For DC motors, the energy requirements are important for the motor and for the AC-to-DC converter used to convert the AC electrical service to DC. The more energy efficient the machines, the smaller and less expensive are the AC-to-DC converters, batteries and motors required to power the machines.

Another factor in cleaning effectiveness is determined by the material of the machine in contact with the floor material. Brushes are effective in loosing material but are not absorbent and therefore are inefficient in removing solid and liquid matter from a floor. For existing machines that use a towel, the towels are typically synthetic and do not absorb and hold solid and liquid matter from a floor. For towels that are primarily cotton, they have the disadvantage of not scrubbing well and also have high friction with the floor surface resulting in low energy efficiency.

Another factor in cleaning effectiveness is determined by the ease of driving the machine across the cleaning surface. Driving the machine is a function of (i) the driving force of the machine, (ii) the surface characteristic of the pad and (iii) the surface characteristics of the floor or other surface over which the pad moves; and (iv) the weight of the machine and hence the cleaning area/weight ratio of the machine.

A desirable feature of a machine allows the handle to extend close to the floor so as to easily fit under furniture. Similarly, battery placement in the handle allows for ease of operation under furniture.

In light of the above background, it is desirable to have improved surface treatment machines for treating carpets, tiles, wood and other surface materials.

SUMMARY

The present invention is a machine for treating a surface lying in an XY plane. The machine includes a body having a body plate, a cleaning plate, a cleaning pad, a drive assembly and an attachment assembly. The cleaning plate is located between the body plate and the XY plane. The drive assembly is connected to the cleaning plate to drive the cleaning plate with a cleaning vibration in an oscillating pattern parallel to the XY plane and producing a drive force for driving the machine over the XY-plane. The attachment assembly flexibly attaches the cleaning plate to the body plate to permit the cleaning plate to vibrate relative to the body plate and to isolate the cleaning vibration from the body.

In one embodiment, a connector is attached to the body for connecting to a member, such as a handle, to move the machine in the XY plane.

In one embodiment, the cleaning vibration is in a range from about 1 mm to 5 mm.

In one embodiment, the drive assembly includes a first motor and a second motor, each attached to the cleaning plate.

In one embodiment, the first motor rotates in one direction and the second motor rotates in the opposite direction.

In one embodiment, the first motor and the second motor each rotate in a range from 1700 to 5000 revolutions per minute.

In one embodiment, the attachment assembly includes a plurality of compression devices connected between the cleaning plate and the body plate for urging the cleaning plate and the body plate toward each other and includes a plurality of rolling separators under pressure from the compression devices for separating the cleaning plate and the body plate.

In one embodiment, the drive assembly includes a motor having a stator fixed to the cleaning plate, a rotor for rotating on a motor axis about the stator, an offset weight rotated asymmetrically by the rotor around the motor axis whereby the cleaning plate is driven with a vibration in an oscillating pattern parallel to the XY plane producing a drive force for driving the machine over the XY-plane.

In one embodiment, the motor is a DC motor and further includes a battery for supplying power to the DC motor.

In one embodiment, the cleaning pad has a plurality of protrusions, the protrusions are aligned at angles in the direction of travel of the machine and the protrusions are formed of micro-fiber polyester cylinders.

In one embodiment, the cylinders have a height in the range of from 10 mm to 25 mm.

In one embodiment, the protrusions have a density in the range of from 3 ounces to 6 ounces per square foot.

In one embodiment, the attachment assembly includes compression devices that are, for example, O-rings, springs, elastic bands or cushioned shaft connectors and the attachment assembly includes a plurality of rolling separators, such as ball bearings, under pressure from the compression devices for separating the cleaning plate and the body plate.

In one embodiment, the drive assembly includes a DC motor and a battery. The motor has a stator fixed to the cleaning plate and the motor has a rotor for rotating on a motor axis about the stator. An offset weight is attached to one section of the rotor and is rotated asymmetrically by the rotor around the motor axis so as to cause a vibration of the motor and the attached cleaning plate. The cleaning plate is driven with a vibration in an oscillating pattern parallel to the XY plane producing a drive force for driving the machine over the XY-plane.

In one embodiment, a sliding or 'Slip & Stick' effect is achieved with the material of the cleaning pad that has cylinders, points, edges, loops, scales or other protrusions angled in the direction of travel. Examples of such protrusions include (i) chenille microfiber that is formed as cylinders or other protrusions where the protrusions have the ability to switch direction from backward to forward; (ii) fabrics that have a directional nap and that are stiff or dense enough so as not to absorb too much of the vibrational energy; (iii) brushes with angled bristles; (iv) a bottom plate or bottom plate attachment that has edges that angle back such as lap siding, shingles, scales or other protrusions. The needed thickness of the protrusions is dependent on the thickness and density of towel being used over the protrusions to enable the edges of the protrusions to register through the towel to the surface being cleaned.

The foregoing and other objects, features and advantages of the invention will be apparent from the following detailed description in conjunction with the drawings.

BRIEF DESCRIPTION OF THE DRAWINGS

FIG. 28 depicts a perspective view of the cleaning pad of FIG. 26 and FIG. 27 with the cylinders inclined at an angle.

FIG. 29 depicts a sectional view of the cleaning pad of FIG. 28 taken along the section line 29-29' of FIG. 28.

FIG. 43 depicts a bottom view of a cleaning pad material having rows and columns of microfiber cylinders.

FIG. 44 depicts a side view of the cleaning pad of FIG. 43.

FIG. 45 depicts a front view of the cleaning pad of FIG. 43.

DETAILED DESCRIPTION

Figure 1:
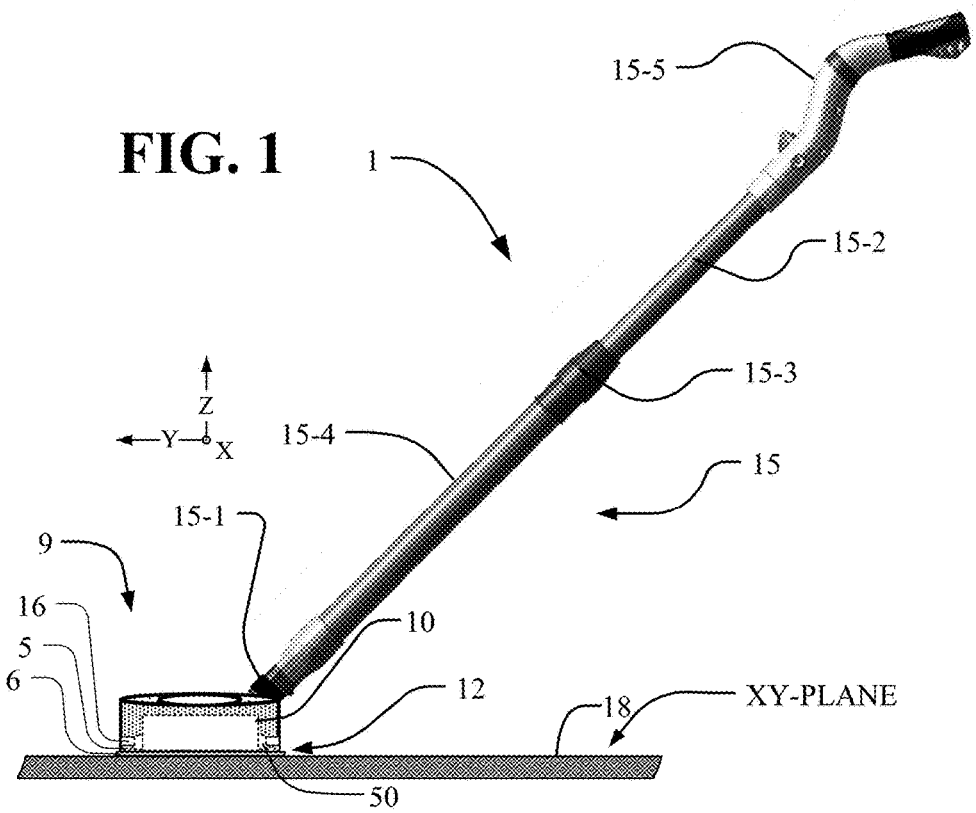
FIG. 1 depicts a side view of one embodiment of a surface treating machine with the handle at an acute angle to a surface to be treated.

In FIG. 1, a surface treating machine 1 includes a body 9 for cleaning, polishing or other treating of the floor or other surface 18 lying in a plane denominated as the XY-plane. The body 9 includes a drive assembly 10, a body plate 16, a cleaning plate assembly 12 and a cleaning head in the form of cleaning pad 6. The body plate 16 is attached to the body 9 and the cleaning plate assembly 12. The cleaning plate assembly 12 is attached to the body plate 16 by a flexible vibration-isolating attachment assembly 50 that permits the cleaning plate assembly 12 to oscillate relative to the body plate 16 and the body 9. The attachment assembly 50 includes rolling separators under pressure from compression devices for separating the cleaning plate 5 and the body plate 16. The cleaning plate assembly 12 includes a cleaning plate 5 and a cleaning pad 6. The drive assembly 10 drives the cleaning plate and cleaning pad with a cleaning vibration in an oscillating pattern parallel to the XY plane and the oscillating pattern generates a drive force for driving the cleaning plate and the surface treating machine 1 in the Y-axis direction.

In FIG. 1, the cleaning pad 6 typically includes a number of protrusions (not shown, see FIG. 32 and FIG. 43 through FIG. 63, for example) that assist and augment driving the cleaning plate and the surface treating machine 1. The protrusions are variously described as modules, cylinders, points, loops, edges, scales, and other similar extensions. The protrusions generally extend in the Z-axis direction but may have an incline in the positive or negative Y-axis direction of movement.

The machine 1 includes a handle assembly 15 affixed to the body 9 for enabling a user to guide machine 1 over a floor surface 18 lying in the XY-plane. The handle assembly 15 has a length extending from the body 9 at a variable angle with the XY-plane and connected to the body by a connector 15-1. The handle assembly 15 includes connector 15-1, a lower extension 15-4, a connector 15-3, an upper extension 15-2 and a curved handle 15-5. The handle assembly 15 is rotationally attached to body 9 and adjusts to acute angles with the cleaning surface 18 when in use for cleaning. The handle assembly 15 includes a latch (not shown) for latching the handle assembly 15 for transport and storage of the machine 1 when not in operation. The connector 15-1 is located near the rear and close to an edge of the body 9, well behind the center of gravity of the machine 1.

Figure 2:
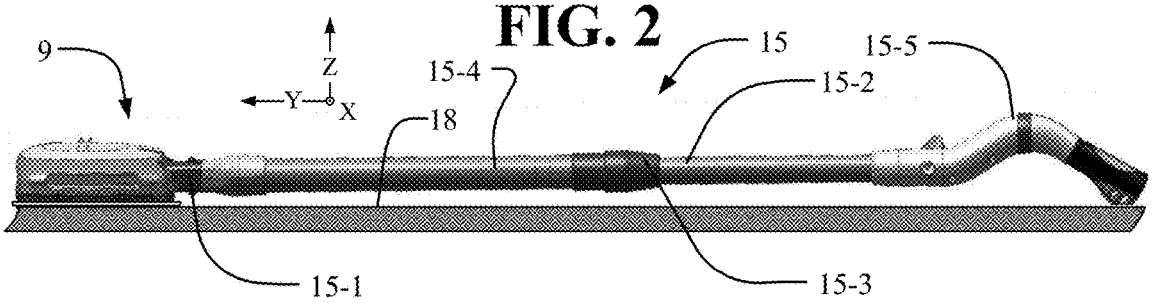
FIG. 2 depicts a side view of the surface treating machine of FIG. 1 with the handle parallel to the surface to be treated.

In FIG. 2, a side view of the surface treating machine 1 of FIG. 1 is shown with the handle 15 parallel to the surface 18 to be treated. The parts of the handle 15 including the connector 15-1, the lower extension 15-4, the connector 15-3 and the upper extension 15-2 typically do not extend above the height of the body 9 in the Z-axis direction when the handle 15 is lowered to the surface 18. Accordingly, the surface treating machine 1 while operating easily fits underneath many pieces of furniture when the handle 15 is lowered as shown in FIG. 2.

Figure 3:
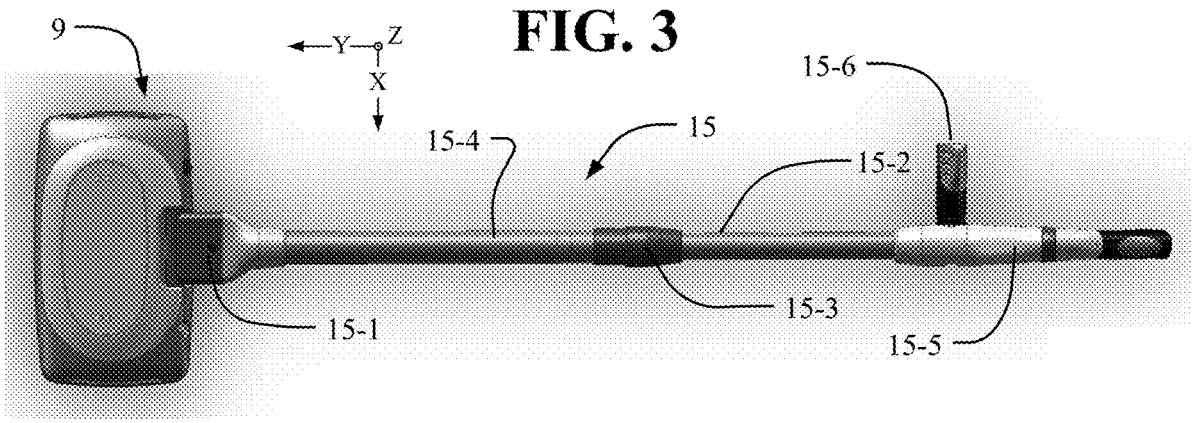
FIG. 3 depicts a top view of the surface treating machine of FIG. 2.

In FIG. 3, a top view of the surface treating machine 1 of FIG. 2 is shown. The handle 15 including the connector 15-1, the lower extension 15-4, the connector 15-3, the upper extension 15-2 and the curved handle 15-5 additionally includes a side grip 15-6. The side grip 15-6 helps to control the surface treating machine 1 and is particularly useful for tipping the body 9 up on an edge rotating the X-axis direction toward the Z In FIG. 4, a front view of an alternate embodiment of a portion of the surface treating machine 1 of FIG. 2 is shown. The cleaning pad 6 extends with a section 6-1 up the side of the body 9 and attaches to the top surface of body 9 with a section 6-2 having part of a hook and loop fastener such as Velcro for attaching to the top surface of body 9 similarly having a complementing part of a hook and loop fastener. Alternatively, in FIG. 4, the extension 6-1 can extend only upward on the side of the body 9 and not onto the top.

Figure 4:
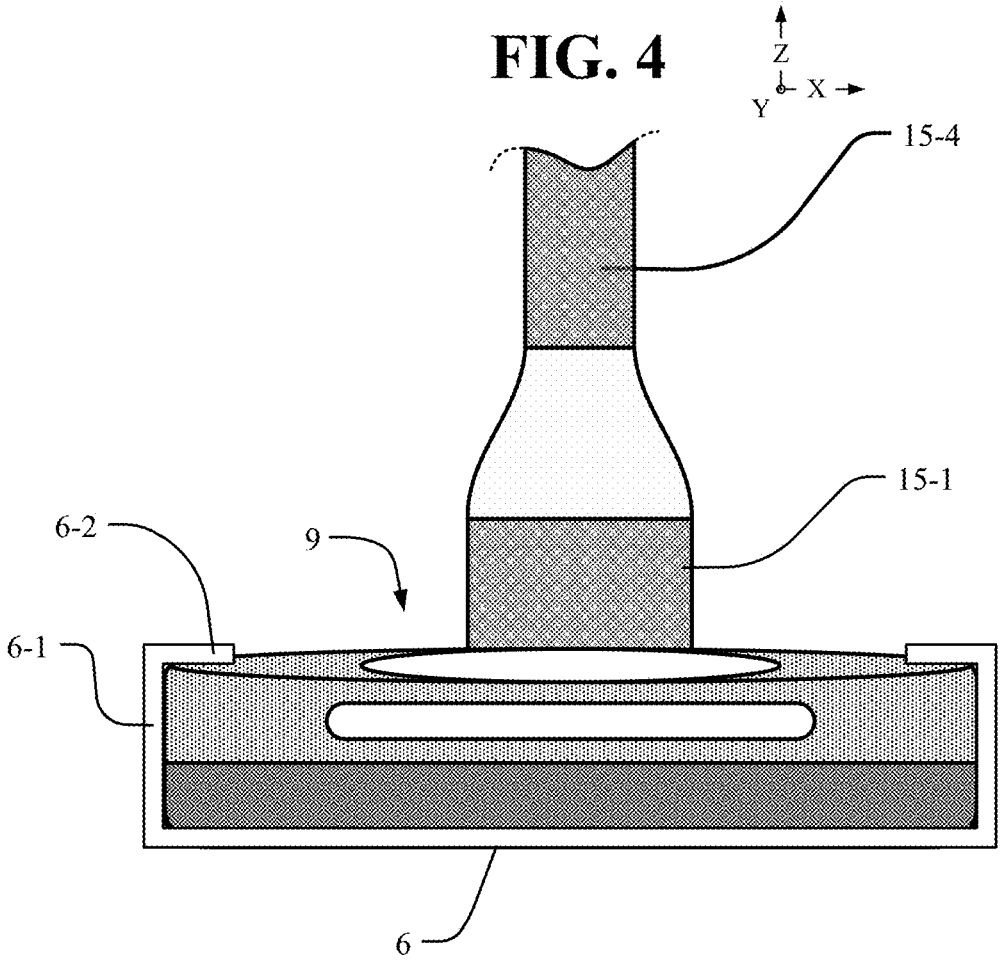
FIG. 4 depicts a front view of a portion of the surface treating machine of FIG. 2.
Figure 5:
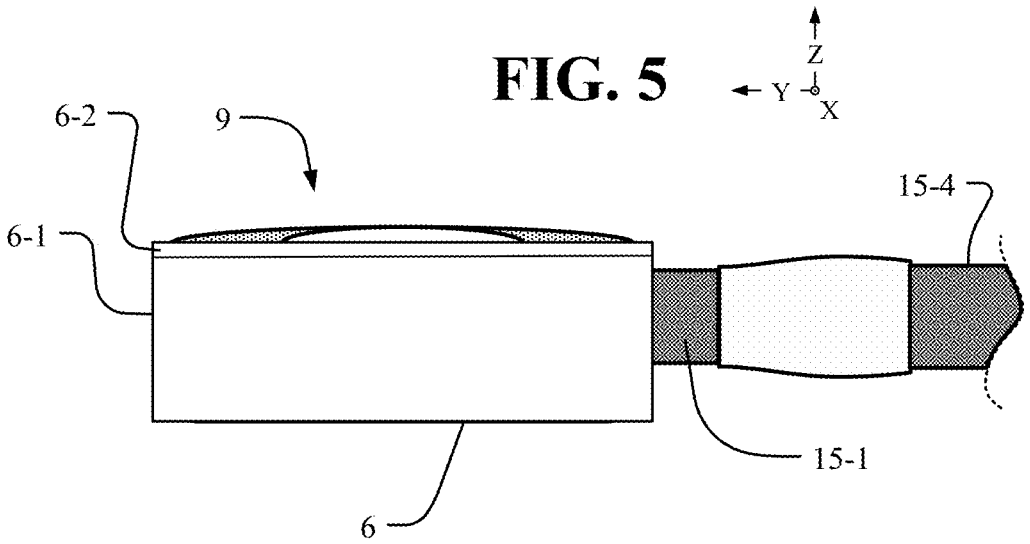
FIG. 5 depicts a side view of the surface treating machine of FIG. 4.

In FIG. 5, a side view of the surface treating machine 1 of FIG. 4 is shown with the pad sections 6-1 and 6-2 extending up to and onto the top of body 9. The handle section 15-1 attaches to the body 9 and to the handle section 15-4.

Figure 6:
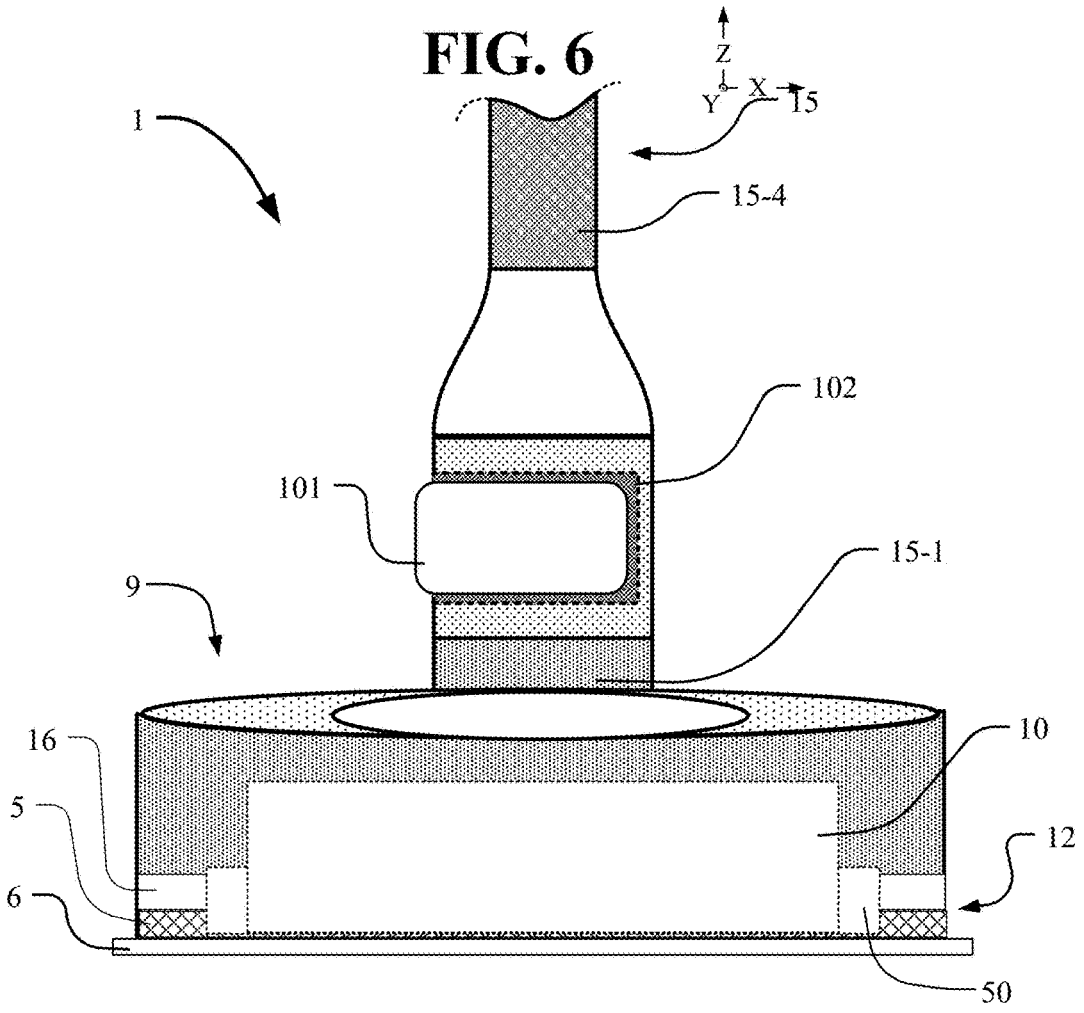
FIG. 6 depicts a front view of a portion of the surface treating machine of FIG. 2 with the addition of a battery.

In FIG. 6, a front view of a portion of the surface treating machine 1 of FIG. 2 is shown with the addition of a battery 101 in a battery compartment 102. The battery compartment 102 is located between the handle section 15-1 and the handle section 15-4 of handle 15. The body 9 includes a drive assembly 10, a body plate 16, a cleaning plate assembly 12 and a cleaning head in the form of cleaning pad 6. The body plate 16 is attached to the body 9 and the cleaning plate assembly 12. The cleaning plate assembly 12 is attached to the body plate 16 by a flexible vibration-isolating attachment assembly 50 that permits the cleaning plate assembly 12 to oscillate relative to the body plate 16 and the body 9. The attachment assembly 50 separates the cleaning plate 5 and the body plate 16. The cleaning plate assembly 12 includes a cleaning plate 5 and a cleaning pad 6. The drive assembly 10 drives the cleaning plate and cleaning pad with a cleaning vibration in an oscillating pattern parallel to the XY plane and the oscillating pattern generates a drive force for driving the cleaning plate and the surface treating machine 1 in the Y-axis direction.

Figure 7:
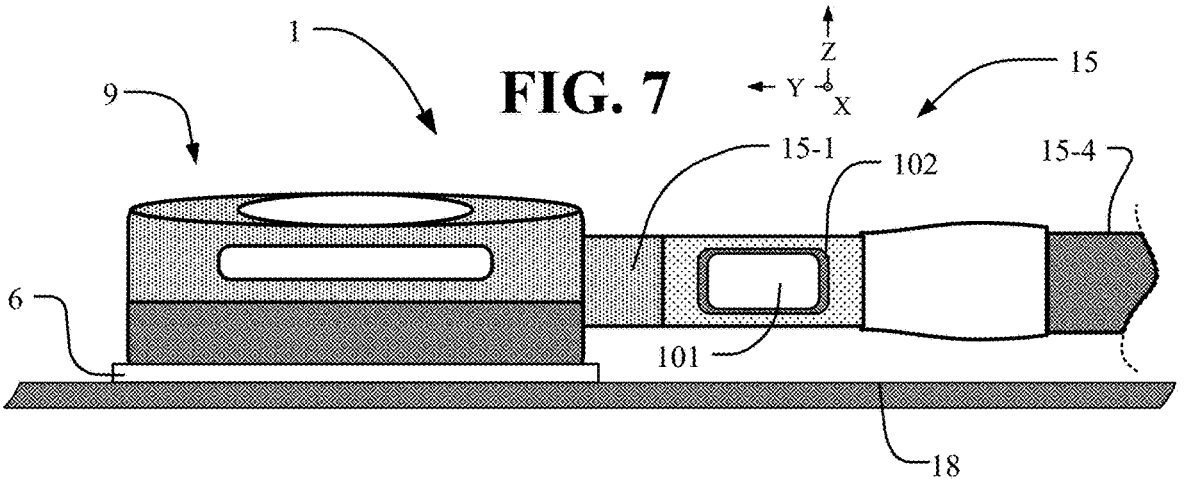
FIG. 7 depicts a side view of the surface treating machine of FIG. 6.

In FIG. 7, a side view of the surface treating machine 1 of FIG. 6 is shown with a body 9 and cleaning pad 6. A battery 101 is in the battery compartment 102. The battery compartment 102 is located between the handle section 15-1 and the handle section 15-4 of handle 15. When the handle 15 is down and parallel to the surface 18 to be treated, the handle 15 and the battery and the battery compartment do not extend above the height of the body 9 in the Z-axis direction.

Figure 8:
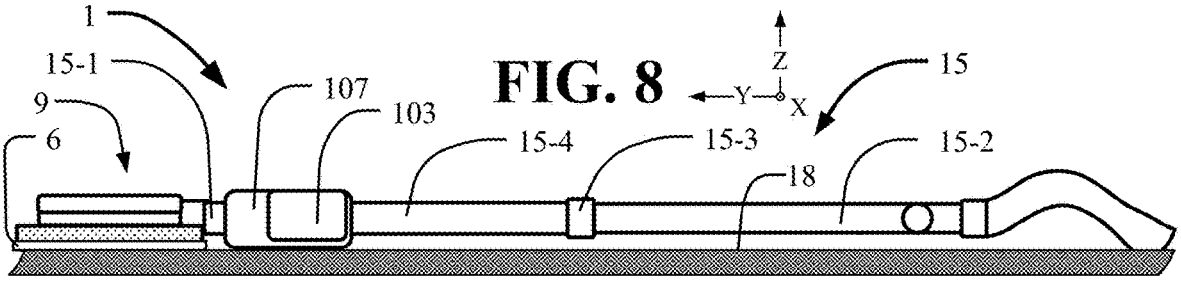
FIG. 8 depicts a side view of another embodiment of a surface treating machine having a battery in a handle with the handle at an angle parallel to a surface to be treated.

In FIG. 8, a side view of another embodiment of a surface treating machine 1 with a body 9 and cleaning pad 6 and having a battery assembly 103 in a handle compartment 107 within the handle 15 where the handle 15 is at an angle parallel to a surface to be treated 18. The handle includes sections 15-1, 15-2, 15-3 and 15-4. The handle compartment 107 and the battery assembly 103 are located between the handle section 15-1 and the handle section 15-4 of handle 15. When the handle 15 is down and parallel to the surface 18 to be treated, the battery assembly 103 and the handle compartment 107 do not extend above the height of the body 9 in the Z-axis direction.

Figure 9:
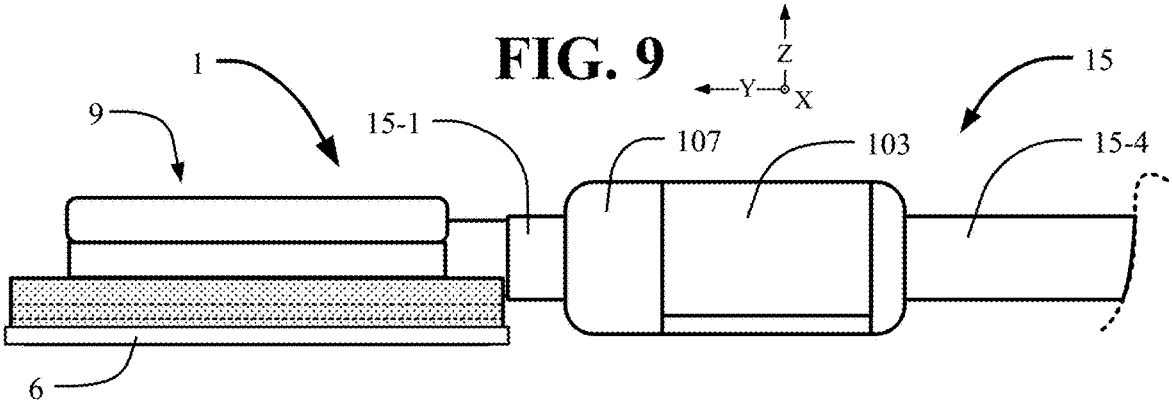
FIG. 9 depicts an expanded side view of a portion of the surface treating machine of FIG. 8.

In FIG. 9, an expanded side view of a portion of the surface treating machine 1 of FIG. 8 is shown having a cleaning pad 6. The surface treating machine 1 has a battery assembly 103 in a handle compartment 107 within the handle 15. The handle compartment 107 and the battery assembly 103 are located between the handle section 15-1 and the handle section 15-4 of handle 15. The body 9 includes a body plate 16 attached to the body 9 and a cleaning plate assembly 12. The cleaning plate assembly 12 is attached to the body plate with flexible attachments that permit the cleaning plate assembly 12 to oscillate relative to the body plate 16 and the body 9.

Figure 10:
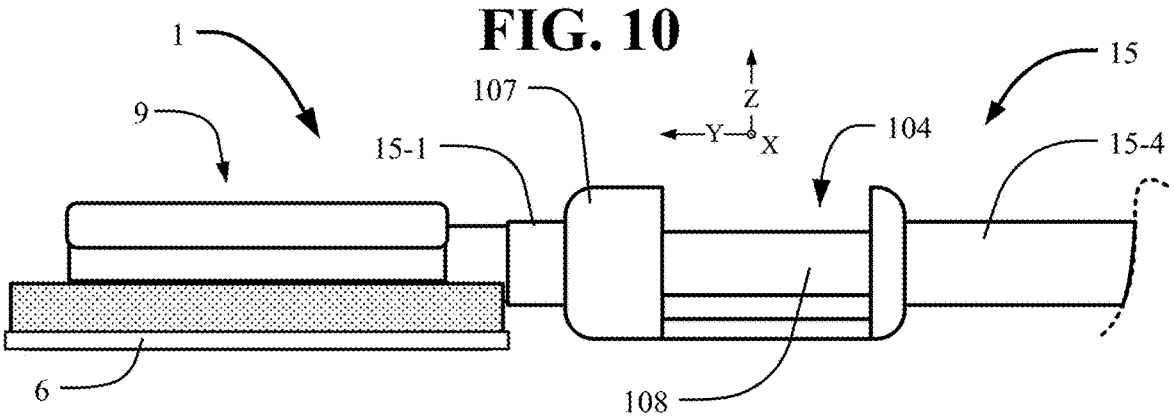
FIG. 10 depicts the surface treating machine of FIG. 9 with the battery cartridge removed.

In FIG. 10, the surface treating machine 1 of FIG. 9 is shown with a body 9, a cleaning pad 6 and with a handle 15. The handle 15 includes a handle compartment 107 located between the handle section 15-1 and the handle section 15-4 of the handle 15. The battery assembly 103 of FIG. 9 is removed revealing the battery opening 104 and the handle section 108 between handle sections 15-1 and 15-4.

Figure 11:
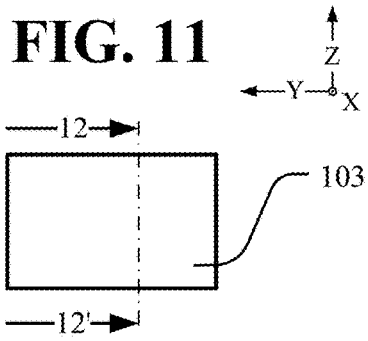
FIG. 11 depicts a side view of the battery cartridge removed from the surface treating machine of FIG. 9.

In FIG. 11, a side view is shown of the battery assembly 103 that has been removed from the surface treating machine 1 of FIG. 10.

Figure 12:
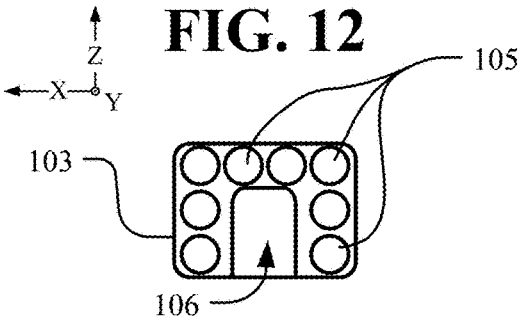
FIG. 12 depicts a sectional view of the battery cartridge of FIG. 11.

In FIG. 12, a sectional view of the battery assembly 103 of FIG. 11 is shown as taken along the section line 12-12' of FIG. 11. The battery assembly 103 has an opening 106 that straddles the handle section 108 of FIG. 10 when the battery assembly 103 is inserted into the handle compartment 107 of FIG. 10. The battery assembly 103 includes a number of batteries 105 for providing battery power for the surface treating machine 1.

Figure 13:
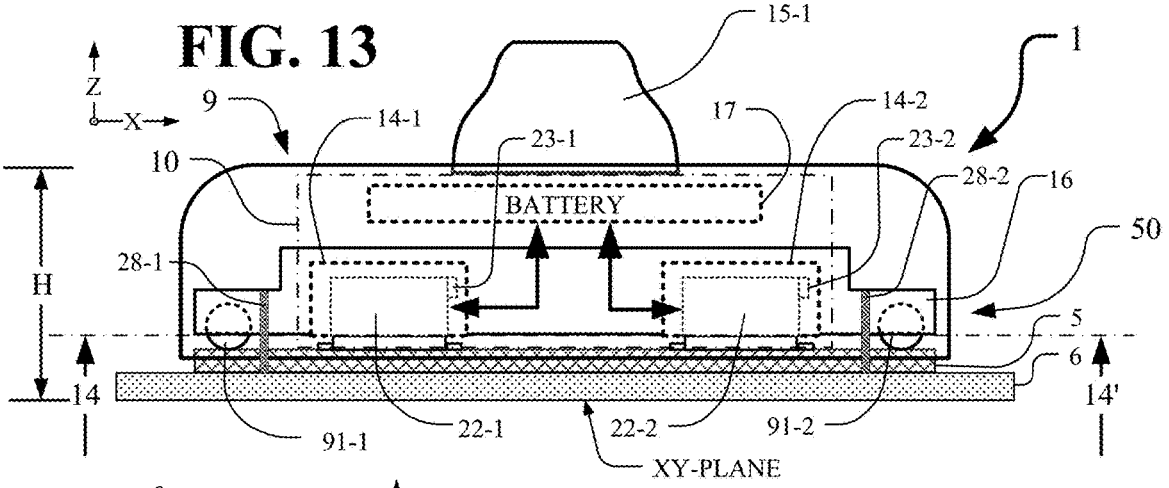
FIG. 13 depicts a schematic cutaway front view of one embodiment of a portion of the machine of FIG. 1.

In FIG. 13, a front view is shown a portion of one embodiment of a surface treating machine 1 including a body 9 connected to handle section 15-1. The body 9 includes a drive assembly 10, a body plate 16, a cleaning plate 5 and a cleaning head in the form of cleaning pad 6. The drive assembly 10 includes motors 22-1 and 22-2 directly connected to the cleaning plate 5. The motors 22-1 and 22-2 include off-set weights 23-1 and 23-2, respectively. The off-set weights 23-1 and 23-2 cause the cleaning plate 5 and the attached cleaning pad 6 to oscillate in the XY-plane, that is, in the plane parallel to the floor or other cleaning surface. The body plate 16 is separated from the cleaning plate 5 by ball bearings 91-1 and 91-2. The compression devices 28-1 and 28-2 urge the body plate 16 and the cleaning plate 5 toward each other while the ball bearings 91-1 and 91-2 hold the body plate 16 and the cleaning plate 5 apart. The ball bearings 91-1 and 91-2 allow the body plate 16 and the cleaning plate 5 to slide parallel to each other and parallel to the XY-plane thereby allowing the cleaning plate 5 to oscillate parallel to the XY-plane.

The motors 22-1 and 22-2 are connected to the cleaning plate 5 and are not connected to the body plate 16 or any other part of the body 9 other than through a vibration-isolating attachment assembly 50 including the compression devices 28-1 and 28-2. The body 9 includes openings 14-1 and 14-2 into which the motors 22-1 and 22-2 extend without contacting the body 9. The motors 22-1 and 22-2 preferably have a small dimension in the Z-axis direction normal to the XY-plane. In one embodiment, the motors 22-1 and 22-2 have a Z-axis dimension of 1.1 inches (28 millimeters). In FIG. 13, the body plate 16 and the cleaning plate 5, in one typical embodiment, measure approximately 12 inches (30.5 cm) by 6.5 inches (16.5 cm) when viewed parallel to the XY-plane. In order to provide stability for the machine 1, the height dimension, H, of approximately 40 millimeters is much less than 0.25 times the minimum treatment dimension, M_D of 16.5 centimeters (see FIG. 14). With an H/M_D ratio of 4/16.5 which is equal to approximately 0.24, the machine 1 is very stable with no noticeable Z-axis instability.

In FIG. 13, a battery and controller unit 17 provides battery power to drive the motors 22-1 and 22-2. The weights 23-1 and 23-2 are in rotational directions by operation of the electrical signals to the motors 22-1 and 22-2. In operation, the first offset weight 23-1 and the second offset weight 23-2, in some embodiments, are maintained at synchronized rotational angles. Synchronized rotational angles are angles that are repeatedly the same for each revolution of the motors. For example, when the first offset weight 23-1 is at 90° and the second offset weight 23-2 is also at 90° for each revolution, then the first offset weight 23-1 and the second offset weight 23-2 are at synchronized rotational angles. The synchronized rotational angles can be any values. By way of further example, the first offset weight 23-1 can be at 0° and the second offset weight 23-2 can be at 180° for each revolution. When the rotational angles differ during different revolutions, the first offset weight 23-1 and the second offset weight 23-2 are maintained at unsynchronized rotational angles. For example, when the first offset weight 23-1 is at 90° and the second offset weight 23-2 is also at 90° for one revolution and the first offset weight 23-1 is at 90° and the second offset weight 23-2 is 75° for another revolution, the first offset weight 23-1 and the second offset weight 23-2 are at unsynchronized rotational angles.

In FIG. 13, the motors 22-1 and 22-2, in one typical embodiment, are 12 pole HobbyKing Donkey ST3508-730 KV outrunner motors. Such motors typically operate with a maximum voltage of 15 volts and with a maximum current of 35 amps. The total height of such motors are 28 mm and revolutions per minute (RPM) at a typical 6 volts of operation is approximately 4100 rpm. For different motors or different embodiments, the revolutions per minute (RPM) of the motors range from about 1700 RPM to about 4500 RPM.

In FIG. 13, a plurality of compression devices, like compression devices 28-1 and 28-2, connected between the cleaning plate 5 and the body plate 16 for urging the cleaning plate 5 and the body plate 16 toward each other. The compression devices like devices 28-1 and 28-2 are, for example, O-rings, springs, elastic bands or cushioned shaft connectors. The compression devices 28-1 and 28-2 in the embodiment of FIG. 13 are O-rings. The attachment assembly 50 includes a plurality of rolling separators, such as ball bearings 91-1 and 91-2, under pressure from the compression devices 28-1 and 28-2 for separating the cleaning plate 5 and the body plate 16. The attachment assembly 50 in alternative embodiments replaces the ball bearings, such as ball bearings 91-1 and 91-2, with sets of magnets. For example, one set of magnets includes a first pair of magnets that operate to pull the cleaning plate 5 and the body plate 16 toward each other in the Z-axis direction and a second pair of magnets that operate to push the cleaning plate 5 and the body plate 16 away from each other in the Z-axis direction. Such magnets are formed in concentric rings or are otherwise located whereby a gap is maintained separating the cleaning plate 5 and the body plate 16 while magnetically keeping the cleaning plate 5 and the body plate 16 in alignment while allowing vibration of the cleaning plate 5. Magnets can also be employed to maintain alignment in the X-axis and the Y-axis direction. Typically, multiple sets of such magnets are employed in place of multiple ball bearings.

Figure 14:
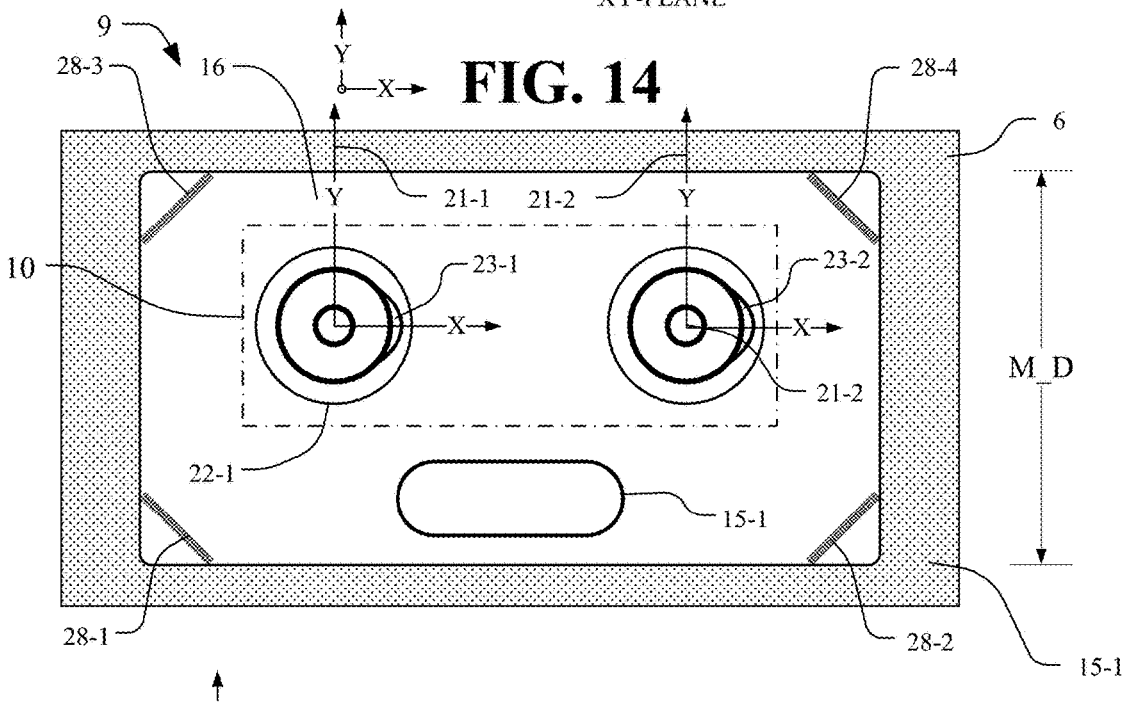
FIG. 14 depicts a schematic top sectional view of the apparatus of FIG. 13 along section line 14-14' of FIG. 13.

In FIG. 14, a schematic sectional top view of the machine 1 of FIG. 13 is shown taken along section line 14-14' in FIG. 13. The drive assembly 10 includes motors 22-1 and 22-2 directly connected to the cleaning plate 5 in FIG. 13. The motors 22-1 and 22-2 include center axes 21-1 and 21-2 about which the rotors (not explicitly shown) of the motors rotate. The motors 22-1 and 22-2 include off-set weights 23-1 and 23-2, respectively. The off-set weights 23-1 and 23-2 cause the attached cleaning pad 6 to oscillate in the XY-plane, that is, in the plane parallel to the floor or other surface to be cleaned by operation of the cleaning plate 5 (as described in connection with FIG. 13). As part of the attachment assembly 50, the compression devices 28-1, 28-2, 28-3 and 28-4, in one embodiment, are O-rings and urge the body plate 16 toward the cleaning plate 5 (as shown in FIG. 13 for compression devices 28-1 and 28-2). The handle connector 15-1 is provided for connecting a handle to the body 9. Typically, the machine 1 is pushed and/or drives itself forward, during surface cleaning or other surface treatment, in the positive Y-axis direction in the XY-plane. As shown in FIG. 14, both of the off-set weights 23-1 and 23-2 at one instance in time are oriented in, or are parallel to, the X-axis direction and hence are defined to have a 0° X-axis orientation. The X-axis direction is normal to the Y-axis direction, that is, normal to the direction of travel. When the motors are rotating, then the off-set weights 23-1 and 23-2 become oriented, at different instances of time, at all the angles from 0° to 360°.

The embodiment of FIG. 13 and FIG. 14 is a machine 1, or part thereof, for treating a surface lying in an XY plane. The machine 1 has a body 9 having a body plate 16, has a cleaning plate 5 located between the body plate 16 and the XY plane, has a drive assembly 10 connected to the cleaning plate 5 to drive the cleaning plate 5 with a cleaning vibration in an oscillating pattern parallel to the XY plane. The cleaning vibration is in a range from 1 mm to 5 mm. The cleaning vibration is measured as the oscillating movement, typically in the Y-axis direction, of the cleaning plate 5 back and forth at a high frequency oscillation of several thousand cycles per minute irrespective of any overall movement of the machine 1 over the floor. The oscillating pattern generates a drive force for driving the cleaning plate over the XY-plane in a direction of travel with an overall movement of the machine 1 over the floor. The machine 1 has an attachment assembly 50 for flexibly attaching the cleaning plate 5 to the body plate 16 under compression to permit the cleaning plate 5 to vibrate relative to the body plate 16 and to isolate the cleaning vibration from the body 9. The compression between the cleaning plate 5 and the body plate 16 is applied by the attachment assembly 50. The attachment assembly 50 includes a plurality of compression devices 28 connected between the cleaning plate 5 and the body plate 16 for urging the cleaning plate 5 and the body plate 16 toward each other. The attachment assembly 50 includes a plurality of rolling separators, such as ball bearings 91, and more particularly 91-1 and 91-2 of FIG. 13, under pressure from the compression devices 28 for separating the cleaning plate 5 and the body plate 16.

Figure 15:
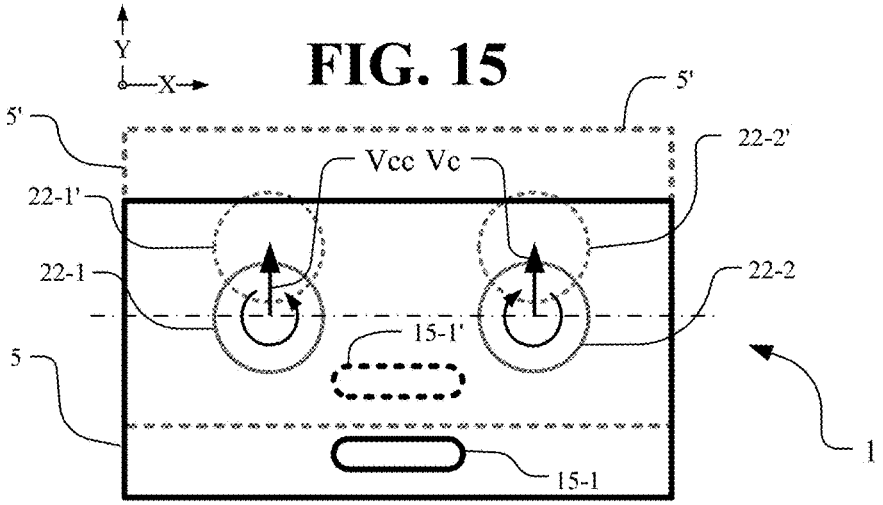
FIG. 15 depicts a schematic representation of the vibration motion and drive travel of the surface treating machines of the present specification.

In FIG. 15, a schematic top view is shown of a portion of a surface treating machine 1. The surface treating machine 1 has first motor 22-1 and second counter rotating motor 22-2. The first motor 22-1 and the second motor 22-2 each have a stator (not shown) connected to the cleaning plate 5. The first motor 22-1 has a rotor (not shown) rotating in the counter clockwise direction and the second motor 22-2 has a rotor (not shown) rotating in the clockwise direction. The first motor 22-1 and the second motor 22-2 are located forward in the Y-axis direction of the connector 15-1 which is part of a handle assembly 15 (not shown, see FIG. 1 and FIG. 2). The rotating first motor 22-1 and the second motor 22-2 have rotational momentum. The magnitude of the rotational momentum is a function of the rotational speed of the motors. Because the motor stators are rigidly attached to the cleaning plate 5, the rotational momentum is transferred by the motor stators to the cleaning plate 5. The rotational momentum in the cleaning plate 5 is bound by the well-known principal of physics known as conservation of rotational momentum. The rotational momentums from each of the first motor 22-1 and second rotating motor 22-2 in the cleaning plate 5 in the X-axis direction tend to cancel. The rotational momentums from each of the first motor 22-1 and second rotating motor 22-2 in the cleaning plate 5 in the Y-axis direction tend to add. As a result, the first motor 22-1 tends to develop a net force vector Vcc in the Y-axis direction in the cleaning plate 5 and the second motor 22-2 tends to develop a net force vector Vc in the Y-axis direction in the cleaning plate 5. As a result of these force vectors, cleaning plate 5 and the attached first motor 22-1 and the second motor 22-2 tend to be driven in the Y-axis direction as shown by the translated broken line cleaning plate 5' and the attached broken line first motor 22-1' and the second motor 22-2'. The driving force resulting from the force vectors has been found to be beneficial and contributing significantly to the ease of operation when advancing the surface treating machine over a surface being cleaned or otherwise treated.

The above analysis of the driving force in the Y-axis direction resulting from rotational momentum is predicated on rotation being parallel or substantially parallel to the XY-plane. Additional, to the extent that rotation is not entirely parallel to the XY-plane, a component of momentum occurs in the Z-axis direction resulting in a net Z-axis force. The Z-axis force tends to interact with the cleaning plate 5. When the cleaning plate 5 has a directional inclination, the Z-axis force tends to help drive the surface treating machine 1.

Figure 16:
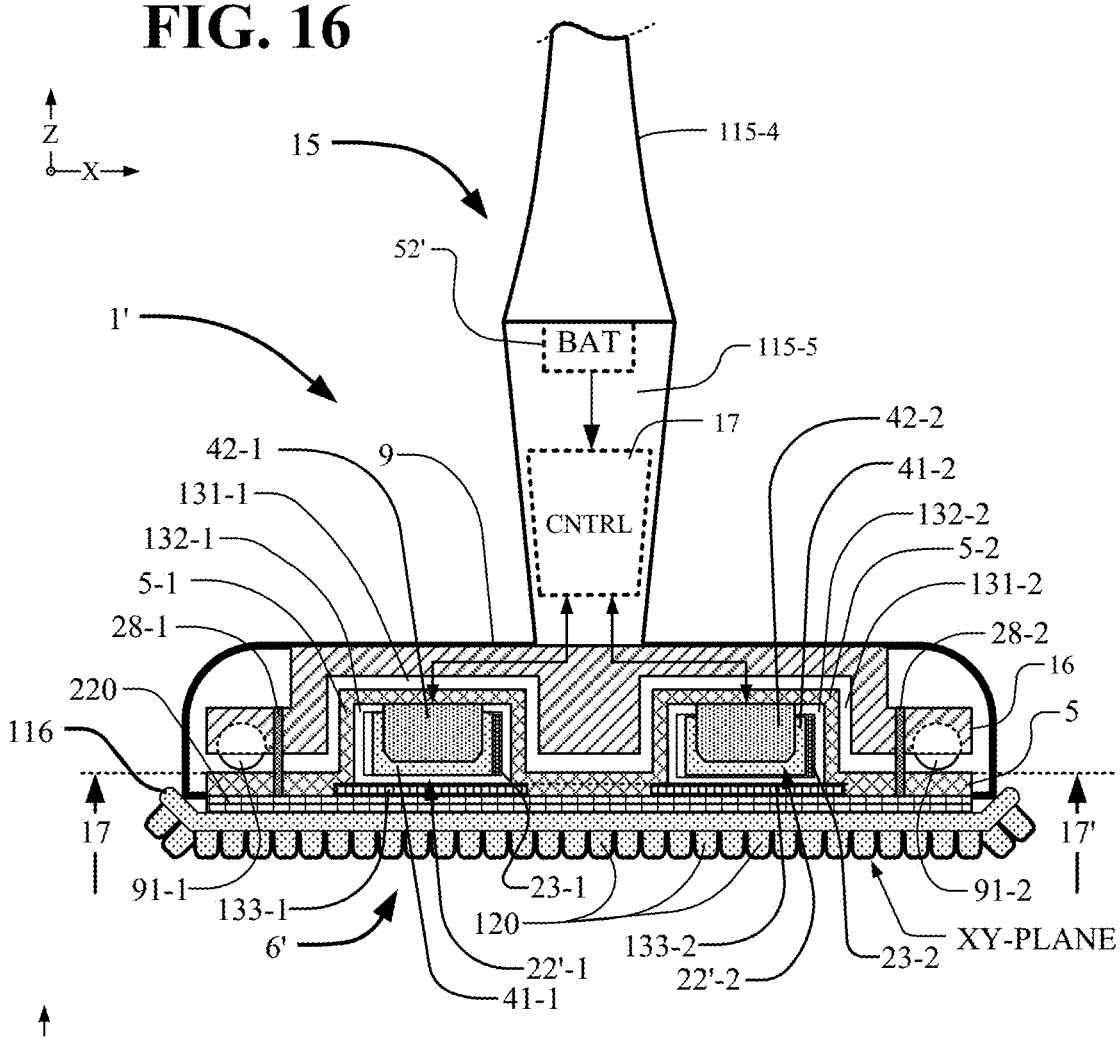
FIG. 16 depicts a schematic cutaway front view of a portion of another embodiment of a surface treating machine.

In FIG. 16, a schematic cutaway front view is shown of another surface treating machine 1'. The surface treating machine 1' includes the body 9 attached to the handle 15. The handle 15 includes handle sections 15-4 and 15-5. The handle 15 swings to different angles relative to the body 9. The handle 15 includes a battery 52' and a control 17. A body plate 16, a cleaning plate 5, a fastener member 220 and a cleaning pad 6' are internal to or general covered by the body 9. The body plate 16 includes recessed chambers 131-1 and 131-2 for receiving motor housings 5-1 and 5-2 which are part of the cleaning plate 5. The recessed chambers 131-1 and 131-2 have closing caps 133-1 and 133-2, respectively. The motors 22'-1 and 22'-2 have stators 42-1 and 42-2, respectively, that typically bolt to or are otherwise attached to the motor housings 5-1 and 5-2 and hence are directly connected to the cleaning plate 5. The motors 22'-1 and 22'-2 have rotors 41-1 and 41-2 that rotate around the stators 42-1 and 42-2 within the chambers 132-1 and 132-2 formed by the motor housings 5-1 and 5-2. The motors 22'-1 and 22'-2 include off-set weights 23-1 and 23-2, respectively. The off-set weights 23-1 and 23-2 cause the cleaning plate 5 and the attached cleaning pad 6' to have an oscillation in the XY-plane, that is, in the plane parallel to the floor or other cleaning surface. The cleaning plate 5, therefore, has a cleaning vibration in an oscillating pattern parallel to the XY plane. The cleaning vibration is in a range from 1 mm to 5 mm as this has been found to be an effective range for cleaning. The body plate 16 is separated from the cleaning plate 5 by ball bearings 91-1 and 91-2. The compression devices 28-1 and 28-2 urge the body plate 16 and the cleaning plate 5 toward each other while the ball bearings 91-1 and 91-2 hold the body plate 16 and the cleaning plate 5 apart. The ball bearings 91-1 and 91-2 allow the body plate 16 and the cleaning plate 5 to slide parallel to each other parallel to the XY-plane thereby allowing the cleaning plate 5 to oscillate parallel to the XY-plane. The pad 6' includes a ticking portion 116 around the outside of the pad 6' and having a size and shape to fit around the bottom of the body 9. The pad 6' includes microfiber cylinders 120.

The motors 22'-1 and 22'-2 in one embodiment are Turnigy Multistar 4225-390 Kv 16 Pole Multi-Rotor Outrunner motors. In the embodiment described, the motors 22'-1 and 22'-2 have a Z-axis dimension of 0.984 inch (25 millimeters) and an X-axis diameter of 1.654 inches (42 millimeters). In FIG. 16, the body plate 16 and the cleaning plate 5, in one typical embodiment, measure approximately 12 inches (30.5 cm) by 6.5 inches (16.5 cm) when viewed parallel to the XY-plane.

In FIG. 16, a battery 52' and control unit 17 provide battery power to drive the motors 22'-1 and 22'-2. The control unit 17' provides either synchronized or unsynchronized power to drive the motors 22'-1 and 22'-2. With synchronized operation, the weights 23-1 and 23-2 are maintained in predetermined rotational directions by operation of the electrical signals to and from the motors 22'-1 and 22'-2. In operation, the first offset weight 23-1 and the second offset weight 23-2, in some embodiments, are maintained at synchronized rotational angles. Synchronized rotational angles are angles that are repeatedly the same for each revolution of the motors. For example, when the first offset weight 23-1 is at 90° and the second offset weight 23-2 is also at 90° for each revolution, then the first offset weight 23-1 and the second offset weight 23-2 are at synchronized rotational angles. The synchronized rotational angles can be any values. By way of further example, the first offset weight 23-1 can be at 0° and the second offset weight 23-2 can be at 180° for each revolution. When the rotational angles differ during different revolutions, the first offset weight 23-1 and the second offset weight 23-2 are maintained at unsynchronized rotational angles. For example, when the first offset weight 23-1 is at 90° and the second offset weight 23-2 is also at 90° for one revolution and the first offset weight 23-1 is at 90° and the second offset weight 23-2 is 75° for another revolution, the first offset weight 23-1 and the second offset weight 23-2 are at unsynchronized rotational angles. As the rotation speed of the motors is increased, the effect of non-synchronized rotation tends to be unimportant because the momentum vectors tend to average to values that are independent of synchronization.

In FIG. 16, a plurality of compression devices, like compression devices 28-1 and 28-2, are connected between the cleaning plate 5 and the body plate 16 for urging the cleaning plate 5 and the body plate 16 toward each other. The compression devices like devices 28-1 and 28-2 are, for example, O-rings, springs, elastic bands or cushioned or other shaft connectors. The compression devices 28-1 and 28-2 in the embodiment of FIG. 16 are elastic bands. A plurality of rolling separators, such as ball bearings 91-1 and 91-2, under pressure from the compression devices 28-1 and 28-2, separate the cleaning plate 5 and the body plate 16.

Figure 17:
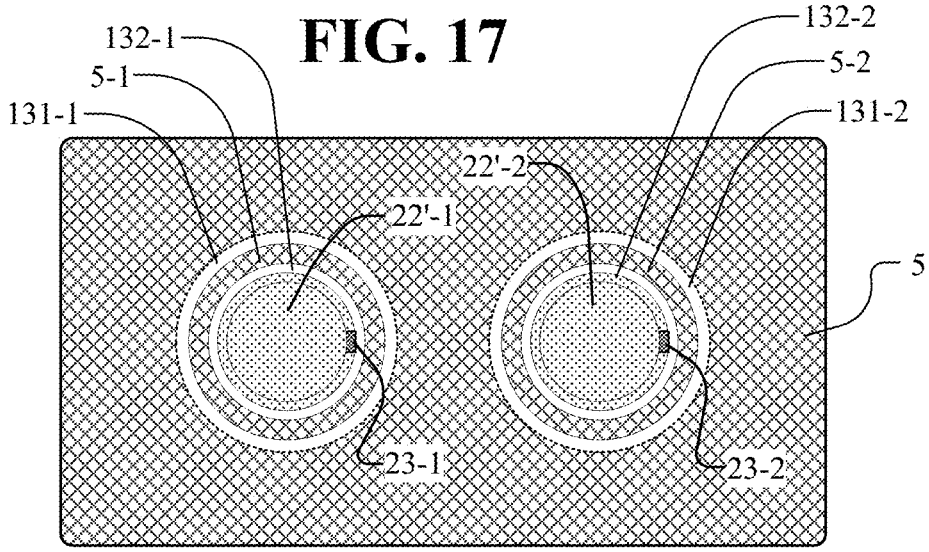
FIG. 17 depicts a schematic top sectional view of the apparatus of FIG. 16 as viewed along a section line 17-17' in FIG. 16.

In FIG. 17, a schematic top section view is shown of the surface treating machine 1' of FIG. 16 as viewed along a section line 17-17' in FIG. 16. The recessed chambers 131-1 and 131-2 receive the motor housings 5-1 and 5-2 which are part of the cleaning plate 5. The motors 22'-1 and 22'-2 include off-set weights 23-1 and 23-2, respectively. The off-set weights 23-1 and 23-2 cause the cleaning plate 5 to oscillate in the XY-plane.

Figure 18:
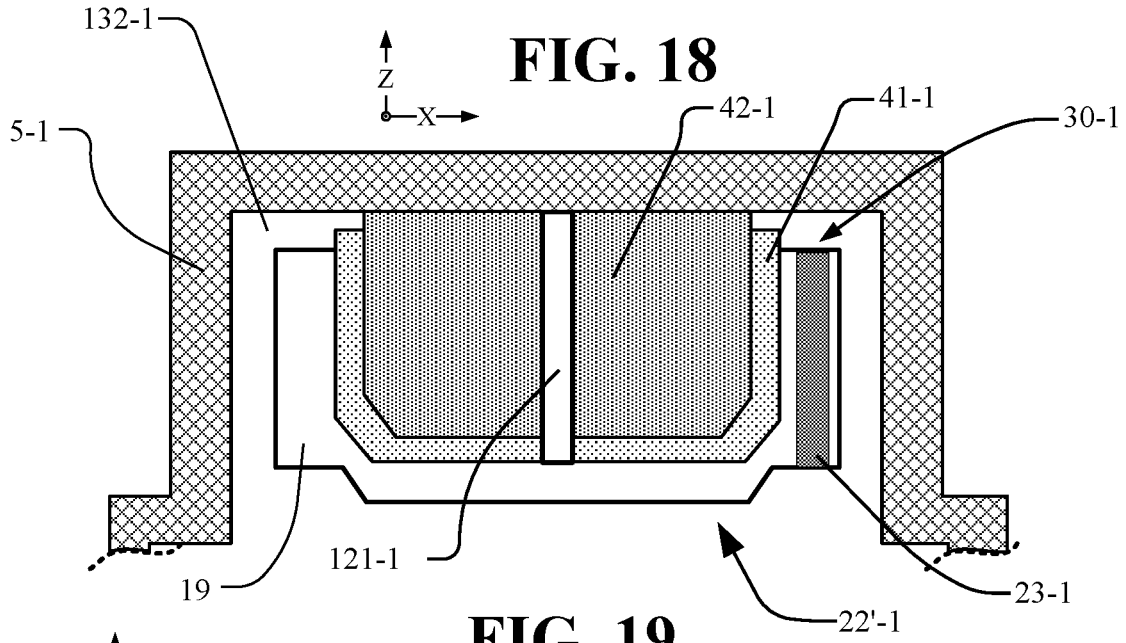
FIG. 18 depicts a detailed front view of one motor of the apparatus of FIG. 16 as viewed along a section line 17-17' in FIG. 16 and the attached portion of the cleaning plate.

In FIG. 18, a detailed front view is shown of one motor 22'-1 of FIG. 16 and the attached portion of the cleaning plate 5-1. The stator 42-1 of the motor 22'-1 is attached to the cleaning plate 5-1 through bolts (or other means not shown). In operation, the rotor 41-1 rotates about the stator 42-1 on motor shaft 121-1 in the recessed chamber 132-1. A ring 19 is attached (by bolts or other means) to the rotor 41-1. The ring 19 includes a plurality of holes located around the periphery, where the hole 30-1 is typical. One or more of the holes is filled with a weight where weight 23-1 in the hole 30-1 is typical. The weights, like weight 23-1, are on one side of the ring 19, in the X-axis direction in FIG. 18, so that when the rotor 41-1, the ring 19 and the weight 23-1 spin, an unbalanced momentum is created that causes the motor 22'-1 and attached cleaning plate 5-1 to oscillate.

Figure 19:
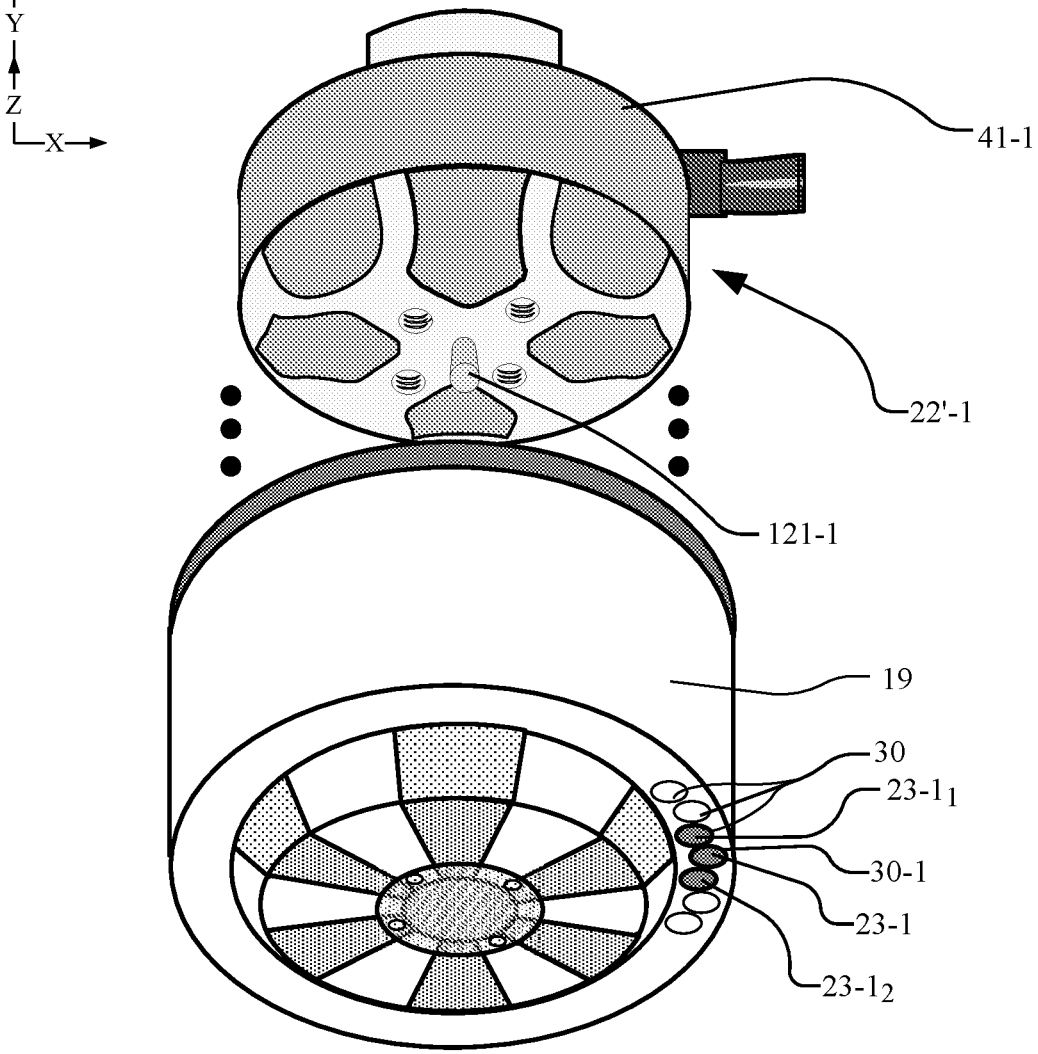
FIG. 19 depicts a detailed perspective view of the motor of FIG. 18.

In FIG. 19, a detailed perspective view is shown of the motor 22'-1 of FIG. 16. In the embodiment shown, the motor 22'-1 is a Turnigy Multistar 4225-390 Kv 16 Pole Multi-Rotor Outrunner motor. The ring 19 includes a plurality of holes 30 located around the periphery, where the hole 30-1 is typical. The hole 30-1 is filled with the weight 23-1. Similarly, the weights 23-1$_1$ and 23-1$_2$ are in ones of the holes 30. The weights 23-1, 23-1$_1$ and 23-1$_2$ are on one side of the ring 19, in the X-axis direction in FIG. 19, so that when the rotor 41-1, the ring 19 and the weights 23-1, 23-1$_1$ and 23-1$_2$ spin around motor shaft 121-1, an unbalanced momentum is created that causes the motor 22'-1 and attached cleaning plate 5-1 of FIG. 18 to oscillate.

While in FIG. 18 and in FIG. 19, holes 30 and weights 23 have been used to provide unbalance to the rotor 41-1, any other similar manner of providing unbalanced weight to the rotor can be employed. For example, weights can be glued or otherwise attached to the rotor housing.

FIG. 18 and in FIG. 19 show the details for motor 22'-1 of FIG. 16 and substantially identical details are present for the motor 22'-2 of FIG. 16.

Figure 20:
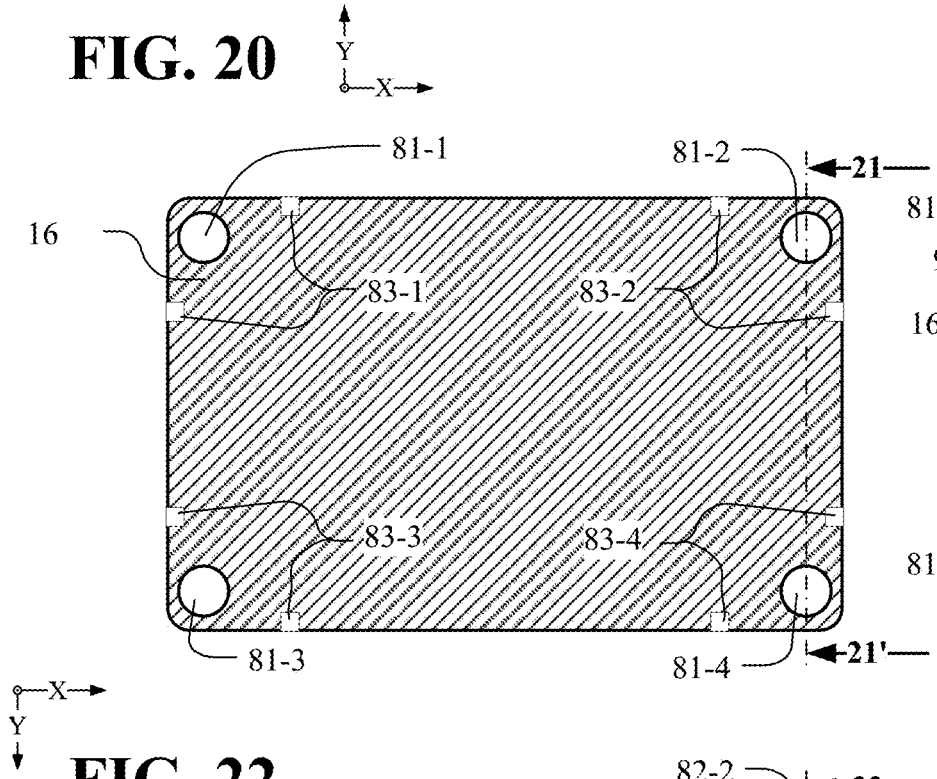
FIG. 20 depicts a bottom view of a body plate of the machine of FIG. 1 and FIG. 13.

In FIG. 20, a bottom view of the body plate 16 of FIG. 13 is shown. The body plate 16 has pockets 81, including pockets 81-1, 81-2, 81-3 and 81-4, for receiving ball bearings. The body plate 16 has notches 83-1, 83-2, 83-3 and 83-4, for receiving the compression O-rings 28-1, 28-2, 28-3 and 28-4 of FIG. 14.

Figure 21:
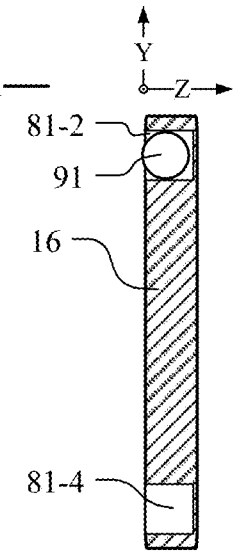
FIG. 21 depicts an end view of the body plate of FIG. 20.

In FIG. 21, an end view of the body plate 16 of FIG. 20 is shown taken along section line 21-21' of FIG. 20. The body plate 16 includes the deep recesses 81-2 and 81-4 for holding ball bearings, like ball bearing 91 shown as typical, in recess 81-2.

Figure 22:
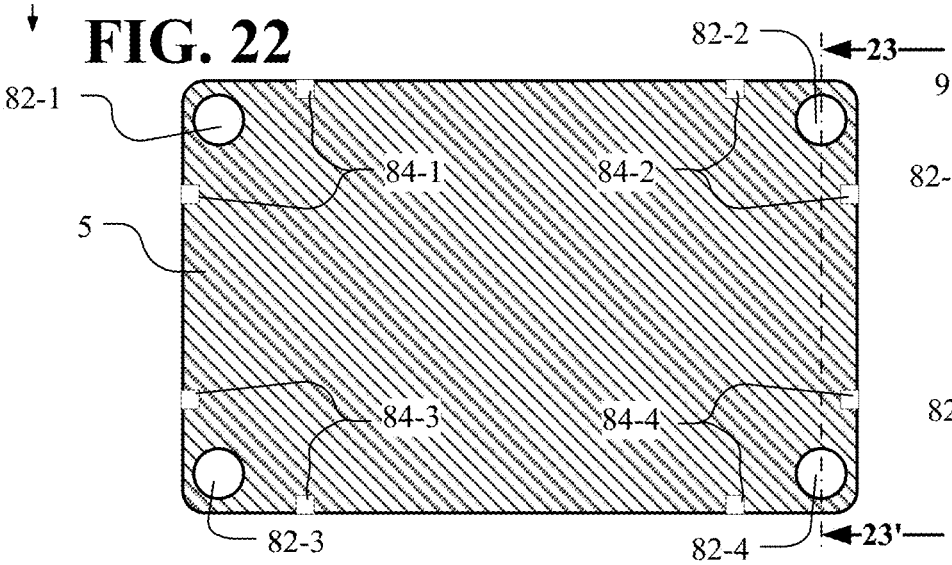
FIG. 22 depicts a top view of a cleaning plate of the machine of FIG. 1 and FIG. 13.

In FIG. 22, a top view of the cleaning plate 5 of FIG. 13 is shown. The cleaning plate 5 has pockets 82, including pockets 82-1, 82-2, 82-3 and 82-4, for receiving ball bearings which are in the pockets 81-1, 81-2, 81-3 and 81-4, respectively, of body plate 16 in FIG. 20. The cleaning plate 16 has notches 84-1, 84-2, 84-3 and 84-4 for receiving the compression O-rings 28-1, 28-2, 28-3 and 28-4 of FIG. 14.

Figure 23:
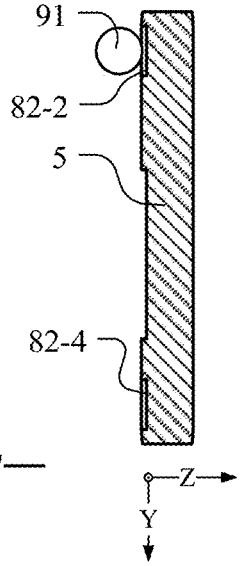
FIG. 23 depicts an end view of the cleaning plate of FIG. 22.

In FIG. 23, an end view of the cleaning plate 5 of FIG. 22 is shown taken along section line 23-23' of FIG. 22. The cleaning plate 5 includes the shallow recesses 82-2 and 82-4 for engaging ball bearings like ball bearing 91 in FIG. 21. The shallow recesses 82-2 and 82-4 are juxtaposed the deep recesses 81-2 and 81-4 of FIG. 20 when the body plate 16 is juxtaposed the cleaning plate 5. The ball bearings, like ball bearing 91, are seated in the deep recesses 81-2 and 81-4 of FIG. 20 and contact the shallow recesses 82-2 and 82-4. The diameters of the ball bearings are greater than the combined depths of the shallow recesses 82-2 and 82-4 of FIG. 23 and the deep recesses 81-2 and 81-4 of FIG. 21 so that the ball bearings hold the body plate 16 apart from the cleaning plate 5.

Figure 24:
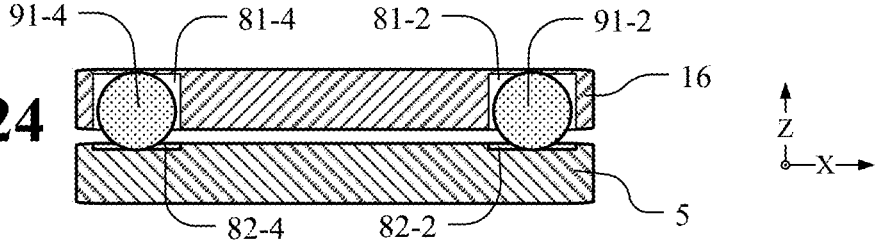
FIG. 24 depicts an end view of the body plate of FIG. 20 juxtaposed the cleaning plate of FIG. 22 and held offset by ball bearings.

In FIG. 24, the fixed body plate 16 is adjacent the cleaning plate 5 and is held offset from the cleaning plate 5 by rolling bearings, particularly ball bearings 91-2 and 91-4, shown as typical. The ball bearing 91-2 rolls in recess 81-2 in body plate 16 and in recess 82-2 in cleaning plate 5. The ball bearing 91-4 rolls in recess 81-4 in body plate 16 and in recess 82-4 in cleaning plate 5.

Figure 25:
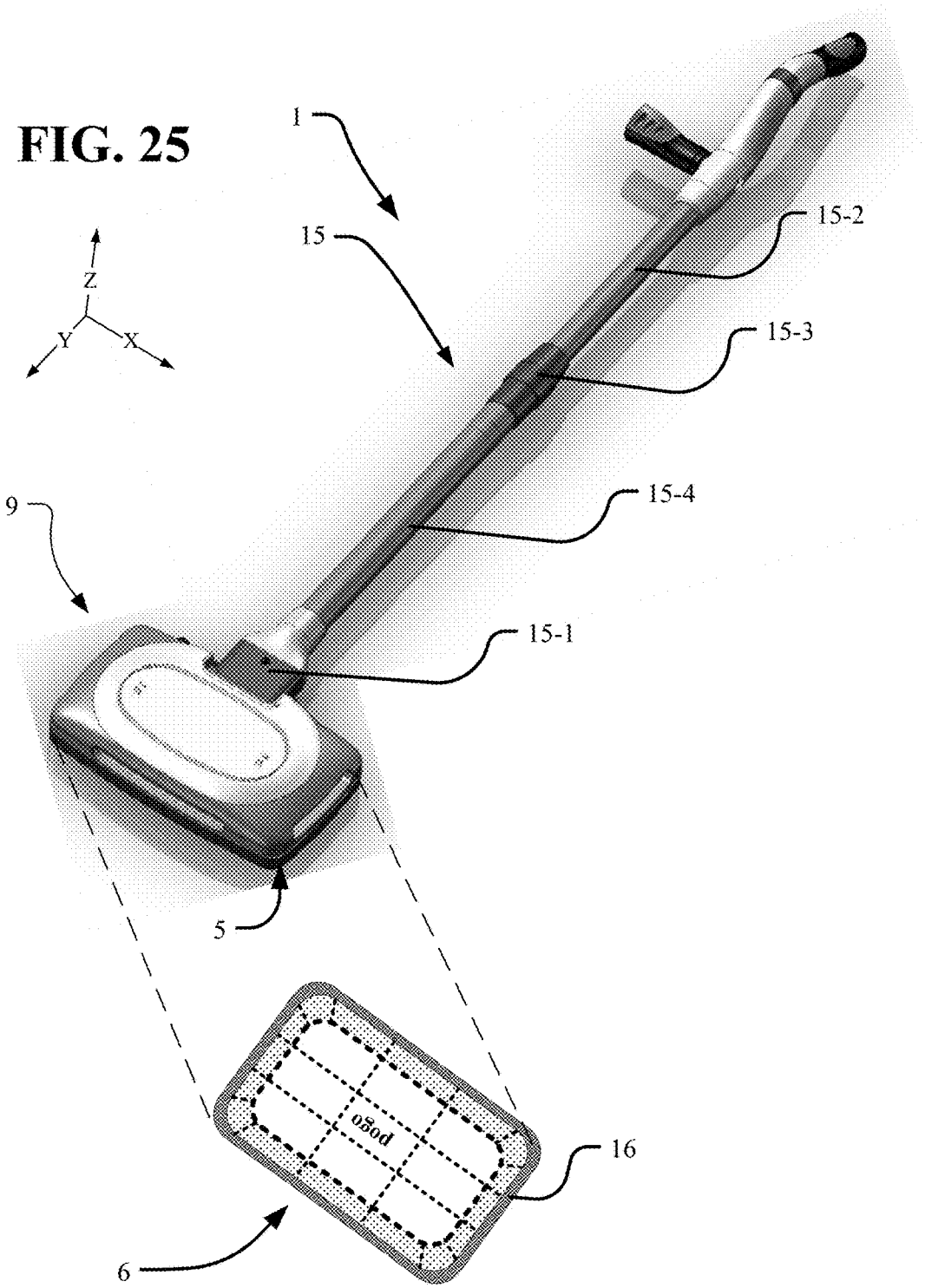
FIG. 25 depicts a perspective view of another embodiment of a surface treating machine offset from a cleaning pad to be attached to the machine.

In FIG. 25, a side perspective view is shown of another embodiment of a surface treating machine 1 having a cleaning pad 6 offset from and to be attached to the machine 1. The surface treating machine 1 includes a body 9 with a handle assembly 15. The handle assembly 15 includes handle connector 15-1, shaft 15-2, clamp 15-3 and handle body shaft 15-4. The clamp 15-3 allows the handle 15 to be lengthened and shortened. The pad 6 is designed to be fastened to the body 9. The pad 6 includes a ticking portion 16 around the outside of the pad 6 and having a size and shape to fit around the bottom of the body 9.

Figure 26:
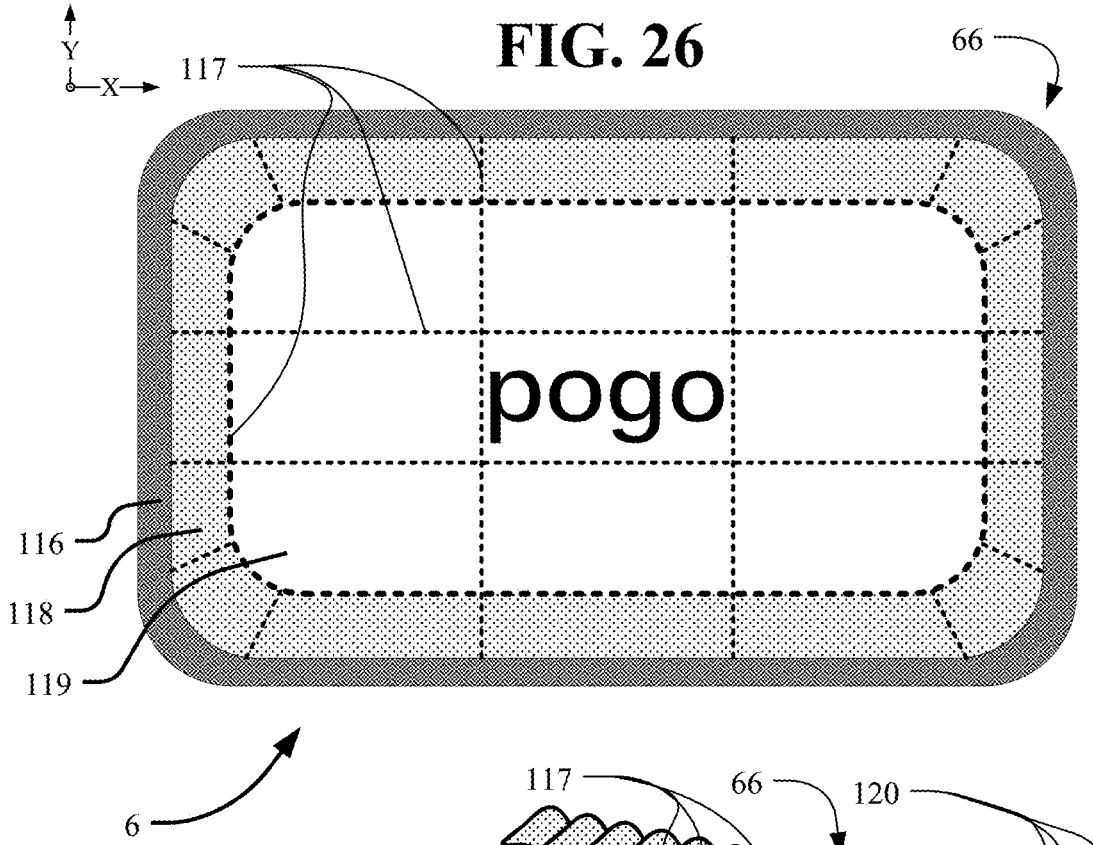
FIG. 26 depicts a top view of a cleaning pad.

In FIG. 26, a top view of a cleaning pad 6 is shown having a bottom portion 119, inclined side portion 118 and a ticking portion 116. The bottom portion 119 and side portion 118 are formed of a first fastener material such as loops which form part of a loop and hook fastener. The back side of the bottom portion 119 and side portion 118 has a fiber layer 66 (see FIG. 27). The bottom portion 119 and side portion 118 are sewn to the fiber layer 66 by threads 117.

Figure 27:
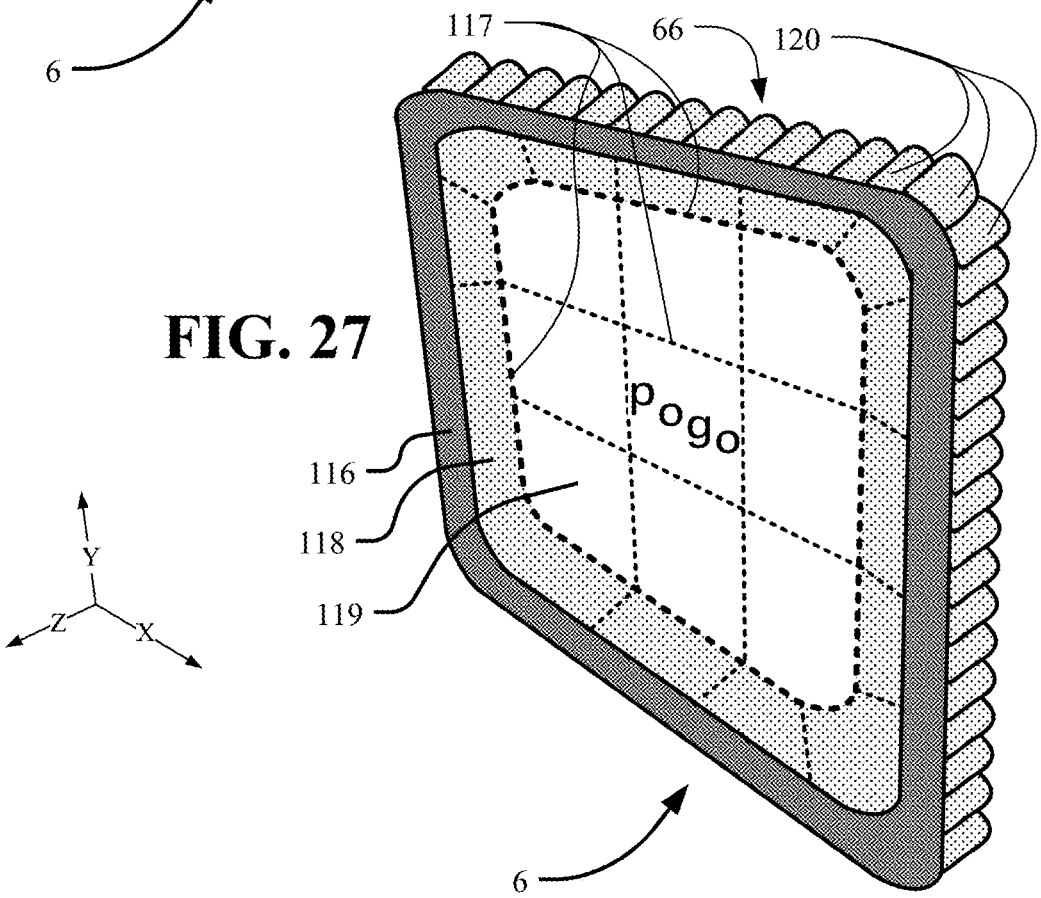
FIG. 27 depicts a perspective view of the cleaning pad of FIG. 26.

In FIG. 27, a perspective view is shown of the cleaning pad 6 of FIG. 26. The bottom portion 119 and inclined side portion 118 form a recess surrounded by the ticking portion 116. The recess is provided to receive the bottom of a surface treating machine (see cleaning plate 5 of machine 1, FIG. 25).

In the embodiment of FIG. 27, the loop layer of pad 6 formed of regions 118 and 119 is sewn to the fiber layer 66 along thread lines 117. In one example, the loop layer formed by regions 118 and 119 is selected to fasten to hooks that are about 0.04 inch so as to form a good loop and hook fastening. In one embodiment, the fiber layer 66 is a chenille fiber and more particularly is polypropylene microfiber formed into cylinders 120. The fiber layer 66 has approximately 12 cylinders per square inch where each cylinder has a diameter of approximately 0.25 inch and a height of approximately 0.6 inch.

In FIG. 28, a perspective view of the cleaning pad 6 of FIG. 26 and FIG. 27 is shown with the cylinders 120 inclined at an angle in the XY-plane. The pad 6 includes the bottom portion 119, inclined side portion 118 and a ticking portion 116 sewn by the thread lines 117. The bottom portion 119 and side portion 118 are formed of a first fastener material such as loops which form part of a loop and hook fastener. The back side of the bottom portion 119 and side portion 118 has a fiber layer 66. The bottom portion 119 and side portion 118 are sewn to the fiber layer 66 by threads 117.

In FIG. 29, a sectional view of a portion of the cleaning pad 6 of FIG. 28 is shown taken along the section line 29-29' of FIG. 28. In FIG. 29, the cylinders 120 are aligned and are at angle of 46° relative to the XY-plane in the fiber layer 66. The cylinders 120 are attached to the layer 119.

Figure 30:
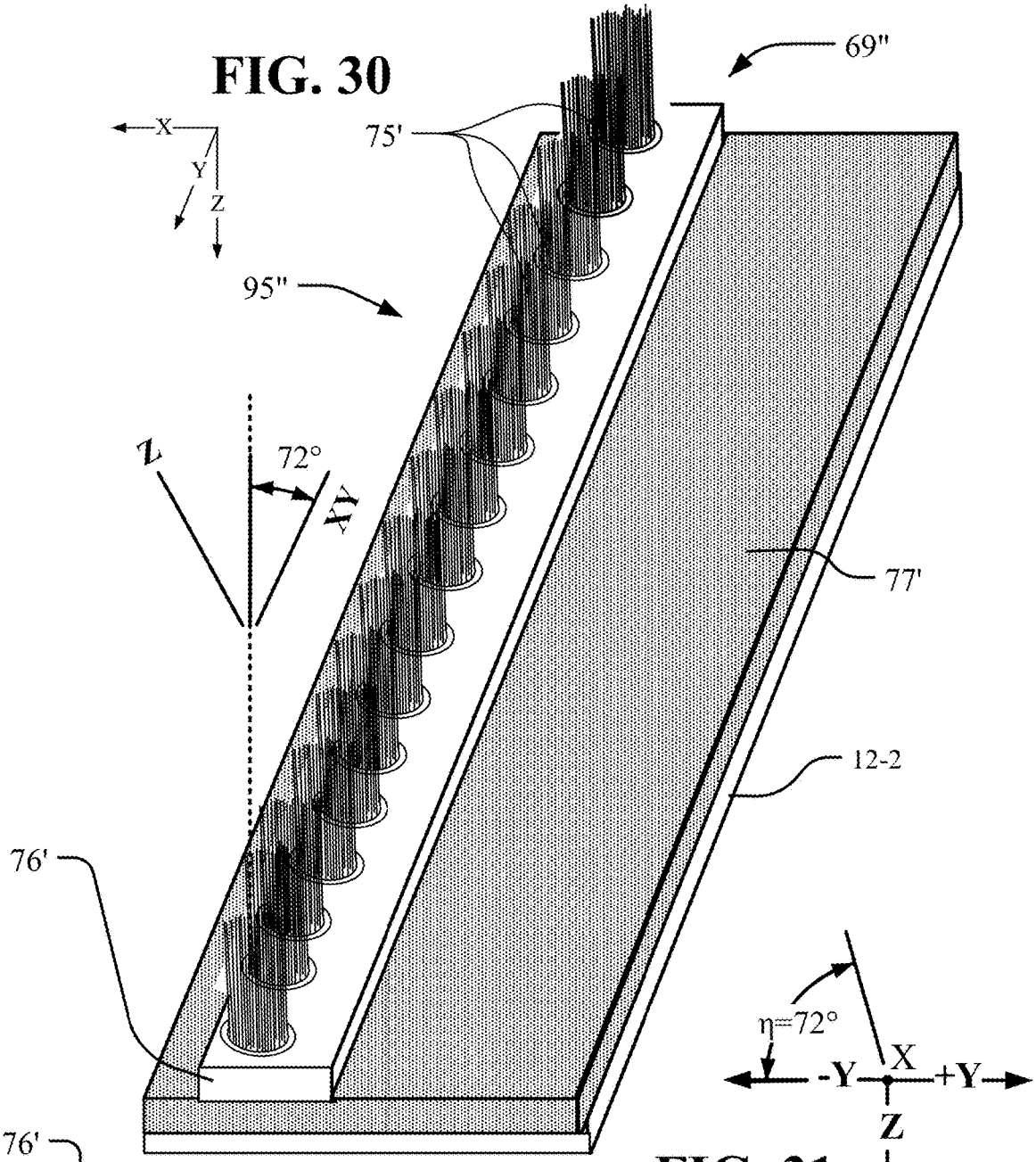
FIG. 30 depicts a perspective view of a single row of brushes mounted at 72 degrees on a wide support member and attached to a fastener member.
Figure 31:
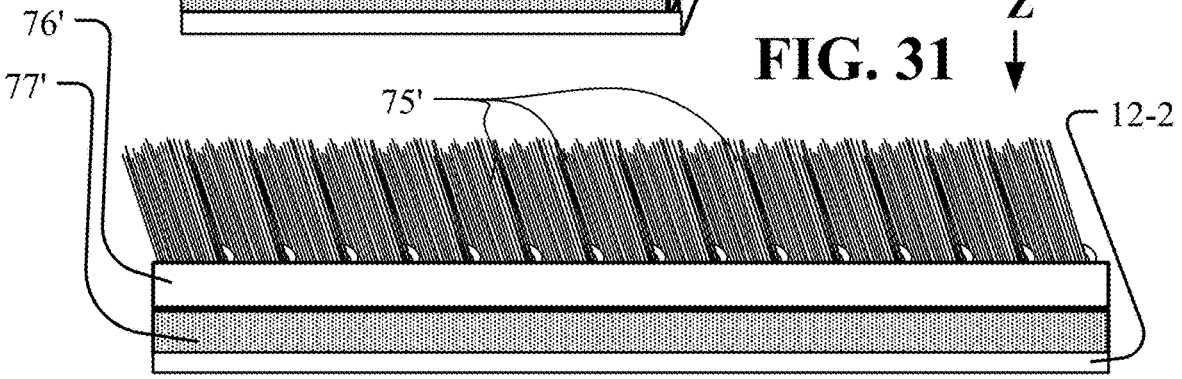
FIG. 31 depicts a side view of the brushes, support member and fastener member of FIG. 30.

In FIG. 30, a perspective view is shown of a brush assembly 69" including a single row of brushes 75' mounted at 72° on a base 76' attached to wide support member 77'. The support member 77' is typically a rigid or semi-rigid material such as ABS plastic, polypropylene, poly carbonate, nylon or other material. The member 77' is not a fastener member and the member 77' and the brush unit 69" are attached to a fastener member 12-2. In FIG. 31, the cylinders 120 are aligned and are at angle of 72° relative to the XY-plane.

Figure 33:
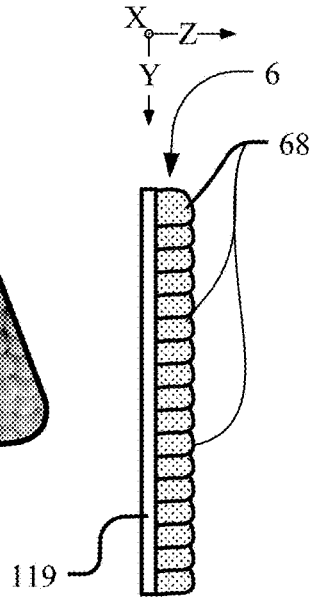
FIG. 33 depicts a side view of the cleaning pad of FIG. 32.

In FIG. 31, a side view is shown of brushes 75', base 76', support member 77' and fastener member 12-2 of FIG. 33. The cylinders 120 are aligned and are at angle of 72° relative to the XY-plane.

Figure 32:
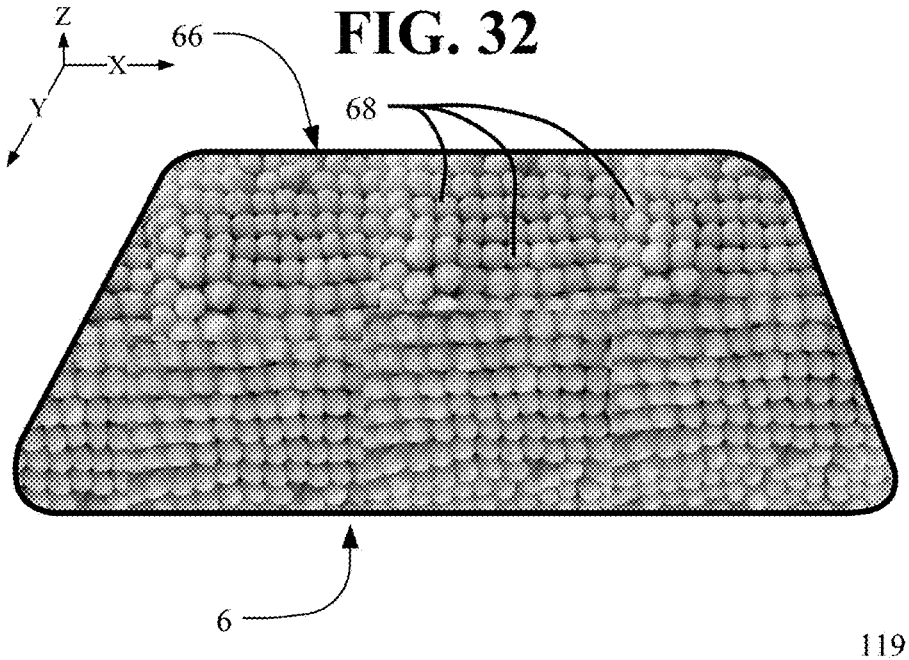
FIG. 32 depicts a top perspective view of the floor-cleaning side of another cleaning pad (mop head).

In FIG. 32, the layer 66 in the embodiment shown is formed of a large number of cylinders 68 for pad 6 of polypropylene microfiber each in the form of a cylinder measuring about 0.4 inches in diameter and about 1 inch high. The polypropylene microfiber 66 is particularly suitable for cleaning tile and hard surface floors and slides over such floors with a comfortable force generated by the machine and by the user pushing on the handle 15 (see FIG. 1 and FIG. 2). For cleaning rugs, particularly rugs with deep pile, the polypropylene microfiber 66 requires considerably more force by the user pushing on the handle 15 (see FIG. 1 and FIG. 2) than is required when a cotton member is used for the pad.

In FIG. 33, a side view of the cleaning pad 6 of FIG. 32 is shown with the cylinders 68 of polypropylene microfiber attached to layer 119 and shown normal to the XY-plane.

Figure 34:
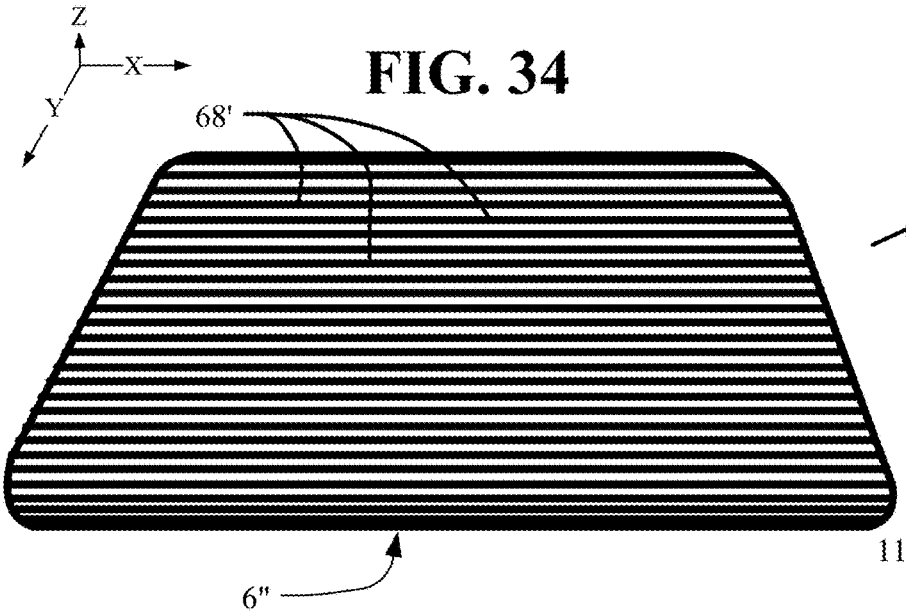
FIG. 34 depicts a top view of the floor-cleaning side of another cleaning pad (mop head).

In FIG. 34, a top view of the floor-cleaning side of another cleaning pad (mop head) 6" is shown. The cleaning pad 6" includes rows of fabric 68' in the XY-plane running in the X-axis direction.

Figure 35:
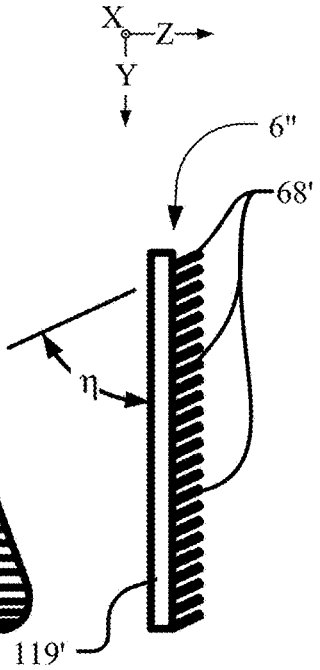
FIG. 35 depicts a side view of the cleaning pad of FIG. 34.

In FIG. 35, a side view of the cleaning pad 6" of FIG. 34 is shown with the rows of fabric 68' attached to layer 119' and shown at an angle of η° to the XY-plane.

Figure 36:
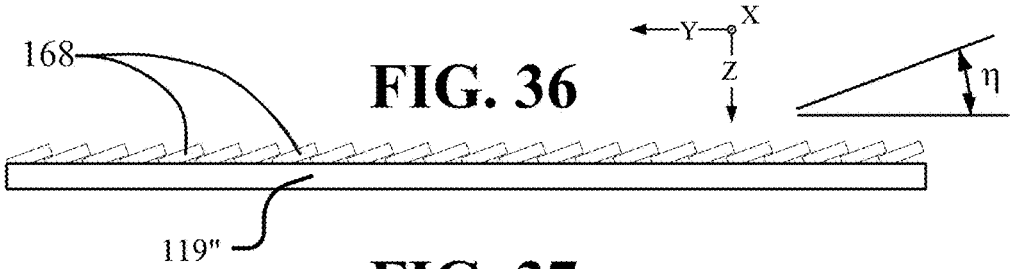
FIG. 36 depicts a side view of a base for another cleaning pad (mop head).

In FIG. 36, a side view of a base layer 119" of another cleaning pad (mop head) is shown with shingled protrusions 168. Each of the shingles 168 is stacked on an adjacent shingle so as to lay at an angle of approximately η°.

Figure 37:
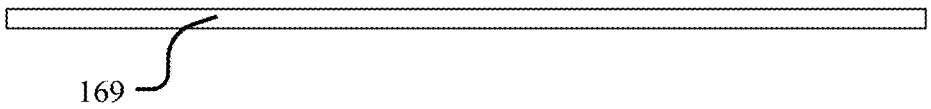
FIG. 37 depicts a side view of a cleaning towel for use with the base of FIG. 36

In FIG. 37, a side view is shown of a cleaning towel 169 for use with the base of FIG. 36.

Figure 38:
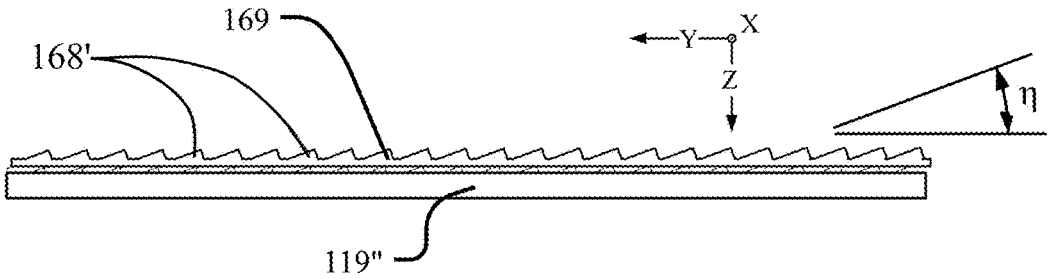
FIG. 38 depicts a side view of the towel of FIG. 37 on the base of FIG. 36 forming another cleaning pad (mop head).

In FIG. 38, a side view of the towel 169 of FIG. 37 is shown on the base of FIG. 36 forming protrusions 168' that correspond to the shingles 168 of FIG. 36. Each of the shingles 168 of FIG. 36 causes the towel 169 to have protrusions 168' that lay at an angle of approximately η°.

Figure 39:
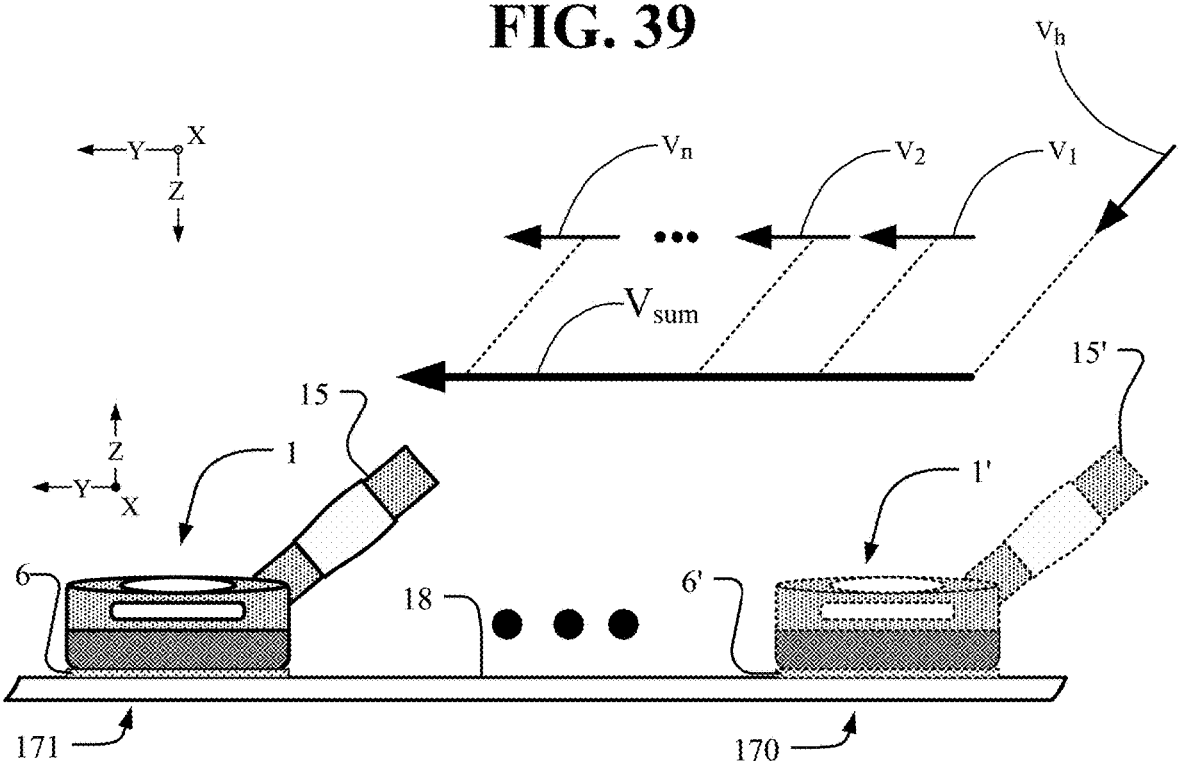
FIG. 39 depicts a vector representation of the drive forces created by the surface treating machines of the present specification and the travel of the machine in response to such forces.

In FIG. 39, a vector representation with local vectors $V_1$, $V_2, \ldots, V_n$ of the drive forces created by the surface treating machines of the present specification and the force $V_h$ from the handle 15 is shown driving the machine 1' (shown with broken line) at a first location 170 to the machine 1 at a second location 171 with a net sum vector $V_{sum}$ driving the machine 1'. Driving the machine 1' at location 170 to the machine 1 at location 171 is a function of (i) the force represented by vector $V_{sum}$, (ii) the surface characteristic of the pad 6' (and 6) and (iii) the floor or other travel surface 18. The net sum vector $V_{sum}$ includes the force generated by the machine 1' and the local vectors $V_1, V_2, \ldots, V_n$, and any additional force from the handle vector $V_h$ imparted by the handle 15'.

Figure 40:
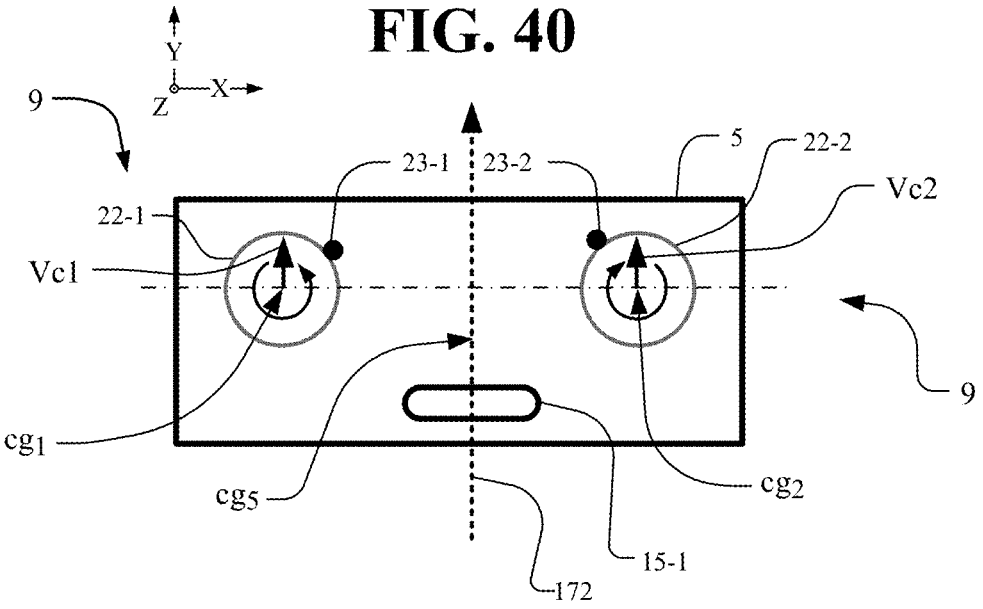
FIG. 40 depicts a representation of the drive plate and the forces generated to drive the machine of FIG. 39.

In FIG. 40, the force generated to drive the machine 1' of FIG. 39 is explained. The force generated by the machine 1' results from a system having two counter-rotating motors 22-1 and 22-2, with off-set weights 23-1 and 23-2, respectively, that are linked as a single system to drive plate 5 where the actual center-of-gravity (cgs) of the system lies between the center of gravities' $cg_1$ and $cg_2$ of the two motors 22-1 and 22-2, respectively. The motors rotate at a frequency, ω, ranging from 1700 rev/minute to 5000 rev/minute. The force generated by the rotation of the motors causes an oscillation of the system and the force is transformed into motion in the Y-axis direction through the system center of gravity line 172. In FIG. 40, the force represented by vector $V_{sum}$ in FIG. 39 is in the XY-plane. The general physics of rotating systems is described in the article "Inertial and Space Warp Principles" published Nov. 24, 2014 at http://www.zamandayolculuk.com/html-3/space_warp_principles.IG.htm.

In addition to the force driving the machine 1', the surface characteristic of the pad 6' (and 6) are important in the driving characteristics of the machine 1'. While cotton is highly absorbent, a microfiber and more particularly a chenille polypropylene microfiber tends to scrub better and release liquids more quickly. Also, the ability of the pad to align cylinders in the direction of travel or opposite direction of travel (Y-axis direction) aids in the driving properties of the machine.

In addition to the other parameters, the surface characteristic of the floors are important in the driving characteristics of the machine 1'. Floors are of many types including hard, smooth floors such as stone and wood and including softer floors such as rugs. Rugs in turn vary widely from firm short naps, longer naps and to plush soft fabrics. Regardless as to the floor composition, the self-driving forces help to propel the machine 1'.

In addition to the other parameters, the weight of the machine and the area of the cleaning surface, that is the area/weight ratio, are important. In general for machines used by nonprofessional consumers such as in the home and in non-cleaning businesses, the area/weight ration typically ranges from about 4 $in^2$/lb to about 15 $in^2$/lb and the weight typically ranges from about 3 lb to about 26 lb. For professional cleaning businesses, the weights of the machines tend to be higher. Light weight machines are easy to transport and hence are desired by non-professional cleaners. In general, the more weight that is imparted to the surface area being cleaned, the better the cleaning result. For any machine, external weights are or can be added temporarily or permanently to increase the weight of the machine and therefore the cleaning effectiveness. For example, weight can be added for short times to clean stubborn stains. Alternatively, the equivalent of added weight is to have the user push down on the machine creating a greater downward force. Also, the machine can be tipped up on its edge whereby the cleaning surface area is much smaller while the weight of the machine stays the same and hence the area/weight ratio is much higher.

Figure 41:
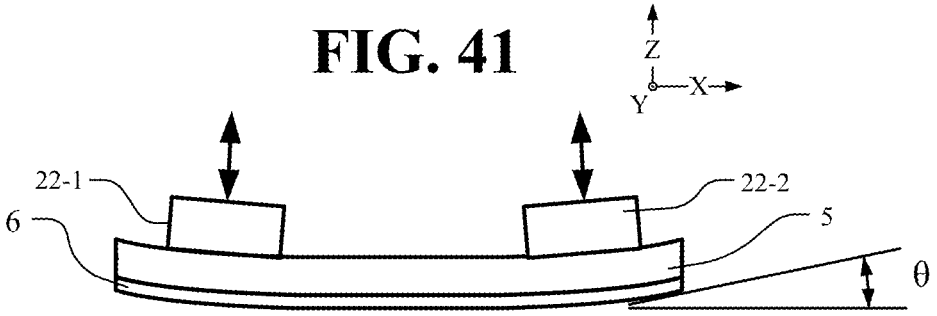
FIG. 41 depicts a front view of a drive plate and pad having a curvature.

In FIG. 41, an alternate embodiment of the cleaning plate 5 is shown. The cleaning plate 5 has a curve in the X-axis direction that at the edges is θ° where θ ranges from a few degrees up to approximately 25°. The curvature of the cleaning plate 5 adds a component of movement to the driving force for the machine 1' of FIG. 39 in the Z-axis direction as oscillation of the cleaning plate 5 occurs. The component of movement in the Z-axis direction helps to lift the cleaning pad 6 slightly so as not to become stuck in floor material, particularly when the floor material is a rug.

Figure 42:
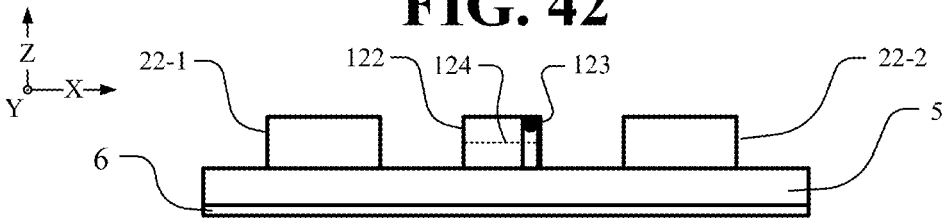
FIG. 42 depicts a front view of a flat drive plate and pad with a motor for driving normal to the cleaning plane.

In FIG. 42, another alternate embodiment of the cleaning plate 5 is shown. When the cleaning plate 5 and pad 6 are flat, with no vertical component in the Z-axis direction of movement generated by motors 22-1 and 22-2, a third motor 122 is provided for adding a Z-axis vertical component of motion. The unbalanced rotor and weight 123 rotate about the motor axis 124 to provide lift, providing a vertical component in the Z-axis direction, to the cleaning pad 6.

In FIG. 43, a top view of a cleaning pad material 140 is shown. The material 140 has 49 rows 141 in the Y-axis direction and 43 columns 142 in the X-axis direction of microfiber cylinders 68.

In FIG. 44, a side view of the cleaning pad material 140 of FIG. 43 is shown having 43 rows 141 of microfiber cylinders on a base material 119.

In FIG. 45, a front view of the cleaning pad material 140 of FIG. 43 is shown having 49 columns 142 of cylinders of microfiber material on a base material 119.

Figure 46:
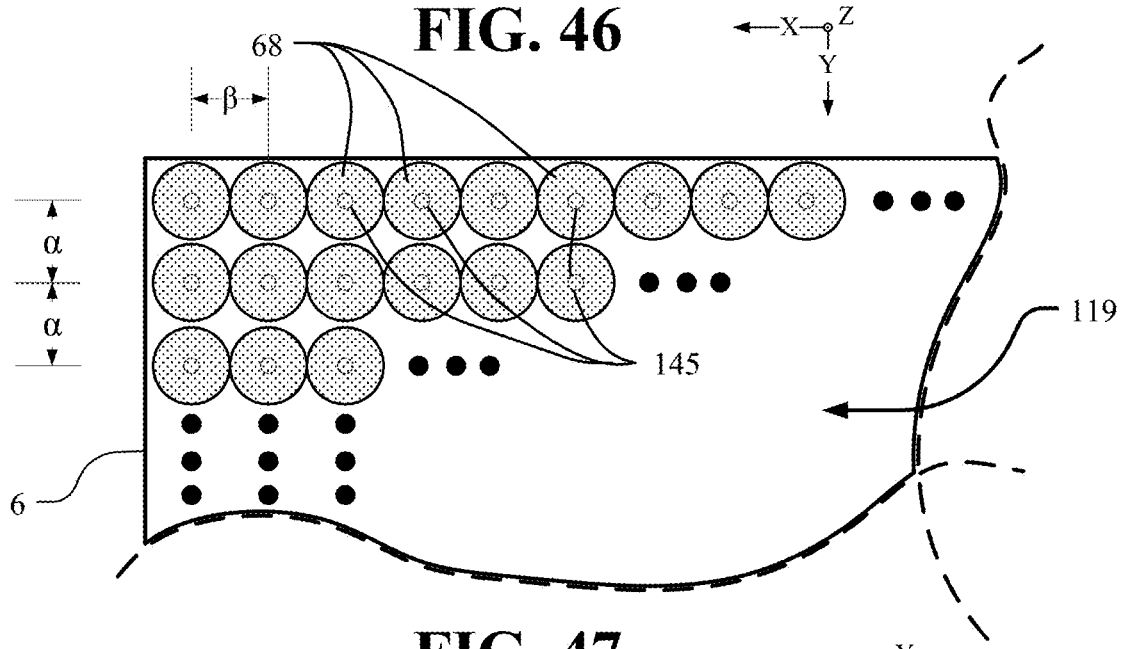
FIG. 46 depicts a bottom view of a portion of a cleaning pad having microfiber cylinders spaced apart in the X-axis direction and in the Y-axis direction.

In FIG. 46, a top view of the portion of a cleaning pad 6 using the FIG. 43 material is shown. The cylinders 68 have a column spacing β and a row spacing α on a base material 119.

Figure 47:
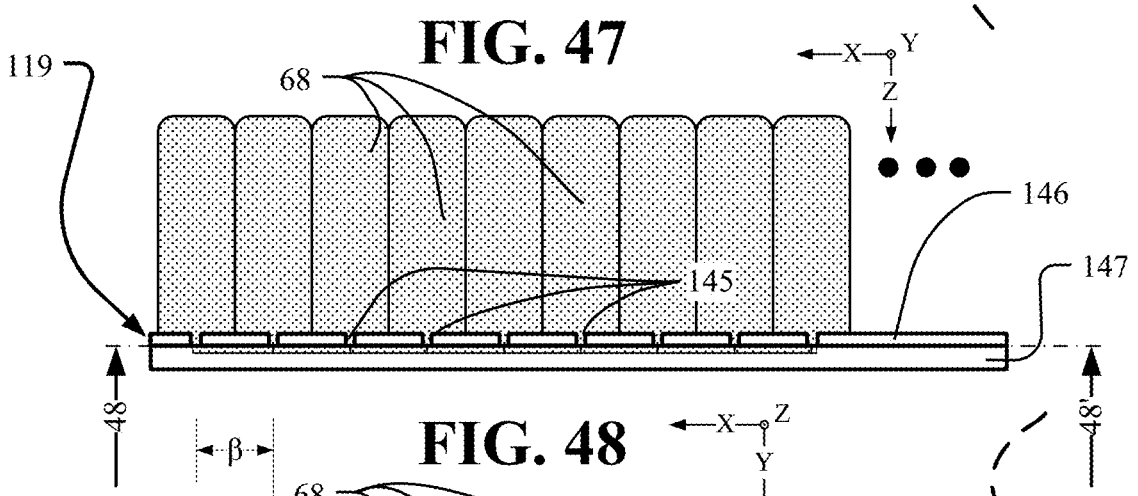
FIG. 47 depicts a front view of the portion of a cleaning pad of FIG. 46.

In FIG. 47, a front view of the pad 6 of FIG. 46 is shown. The cylinders 68 are formed, in one embodiment, of chenille polypropylene microfiber. Typically, the microfiber is a continuous string that extends through holes 145. The microfiber for each hole extends in one direction (negative Z-axis direction) through a hole 145 and then returns through the same hole 145 in the opposite direction (positive Z-axis direction) in base material 146. The continuous string of microfiber material extends from one hole 145 to the adjacent hole 145 and so on and in this way populates all the cylinders 68, for example, all the cylinders 68 in FIG. 43 through FIG. 48. A base 147 of nylon or other material is sewn to the base 146 to form the layer 119.

Figure 48:
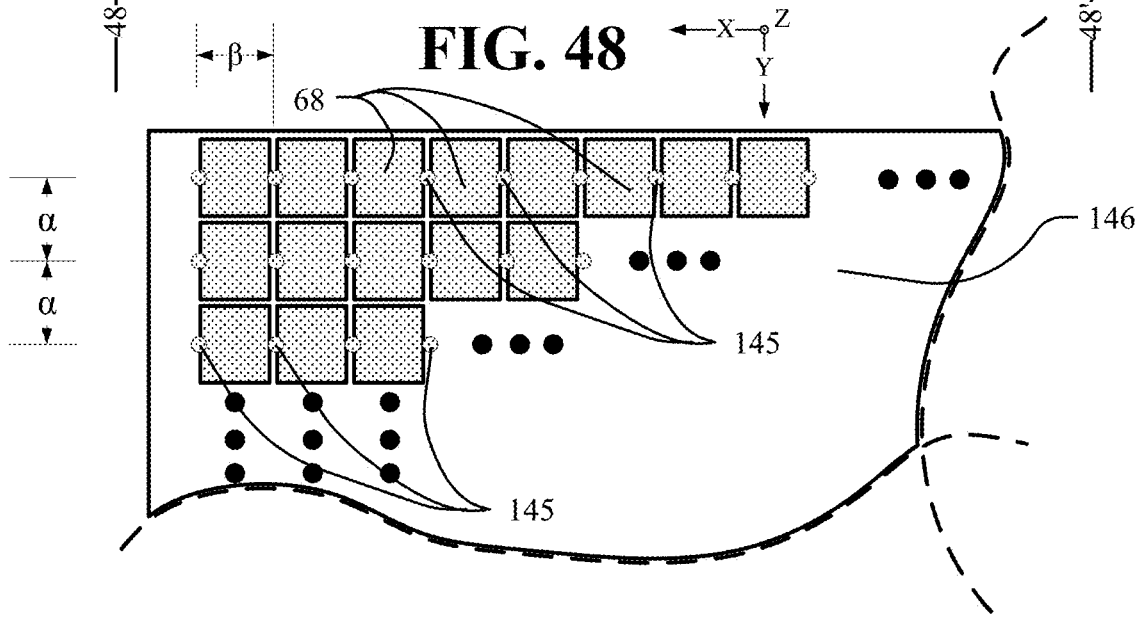
FIG. 48 depicts a sectional view of the portion of a cleaning pad of FIG. 47 taken along the section line 48-48' of FIG. 47.

In FIG. 48, a sectional view of the portion of a cleaning pad 6 of FIG. 47 is shown taken along the section line 48-48' of FIG. 47. The chenille polypropylene microfiber 68 is typically a continuous string that extends through holes 145 in base 146 to form the cylinders 68 in FIG. 46 and FIG. 47.

Figure 49:
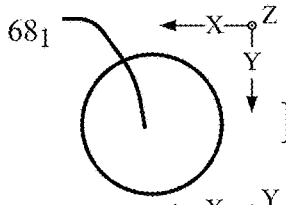
FIG. 49 depicts a top view of one typical microfiber cylinder.

In FIG. 49, a top view of one typical microfiber cylinder $\mathbf{68}_1$ is shown. The cylinder $\mathbf{68}_1$ has a diameter of approximately 7.5 mm.

Figure 50:
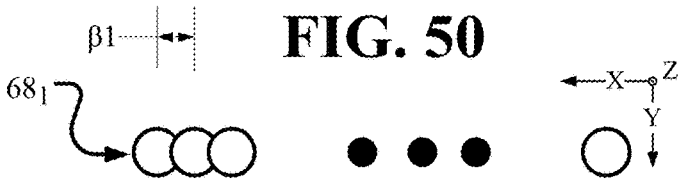
FIG. 50 depicts a row of microfiber cylinders of the FIG. 49 size arrayed with a row spacing $\beta 1$.

In FIG. 50, a row of microfiber cylinders $\mathbf{68}_1$ of the FIG. 49 size are arrayed with a row spacing β1 for cylinders $\mathbf{68}_1$. In one embodiment 49 cylinders are arrayed in a row in the X-axis direction for a 305 mm (approximately 12 inch) pad. Similarly, 42 rows of 49 cylinders per row are arrayed in the Y-axis direction for a 305 mm (approximately 12 inch) pad.

Figure 51:
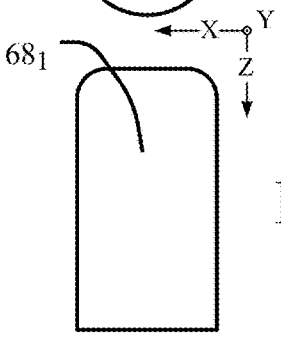
FIG. 51 depicts a front view of the microfiber cylinder of FIG. 49.

In FIG. 51, a front view of the microfiber cylinder $\mathbf{68}_1$ of FIG. 49 is shown. The cylinder $\mathbf{68}_1$ has a height of approximately 14 mm with a diameter of approximately 7.5 mm.

Figure 52:
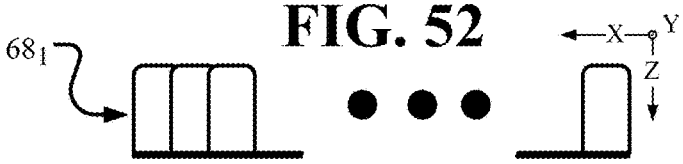
FIG. 52 depicts a front view of the microfiber cylinders of the FIG. 51 size arrayed with a row spacing $\beta 1$ as shown in FIG. 50.

In FIG. 52, a front view of the microfiber cylinders $\mathbf{68}_1$ of the FIG. 49 are arrayed with a row spacing β1 as shown in FIG. 50.

In the embodiment of FIG. 49 through FIG. 52, 49 cylinders are arrayed in a row in the X-axis direction for a 305 mm (approximately 12 inch) pad. Similarly, 42 rows of 49 cylinders per row are arrayed in the Y-axis direction for a 305 mm (approximately 12 inch) pad. A typical pad using the FIG. 49 through FIG. 52 material, measures 10 inches in the X-axis direction and 9 inches in the Y-axis direction and has 37 tuffs are in the X-axis direction and has 32 tuffs in the Y-axis direction. The density of one embodiment of such a pad was 5.46 ounces per square foot before the backing layer such as layer 147 in FIG. 47 was attached.

Figure 53:
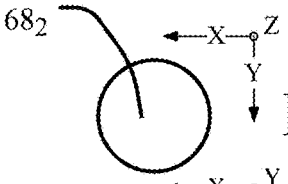
FIG. 53 depicts a top view of another typical microfiber cylinder.

In FIG. 53, a top view of one typical microfiber cylinder $\mathbf{68}_2$ is shown. The cylinder $\mathbf{68}_2$ has a diameter of approximately 6.0 mm.

Figure 54:
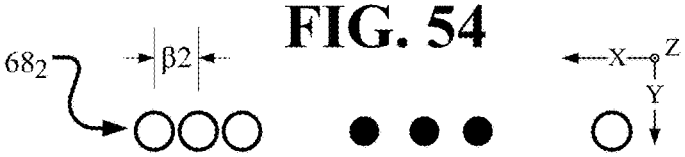
FIG. 54 depicts a row of microfiber cylinders of the FIG. 53 size arrayed with a spacing $\beta 2$.

In FIG. 54, a row of microfiber cylinders $\mathbf{68}_2$ of the FIG. 53 size are arrayed with a row spacing β2 for cylinders $\mathbf{68}_2$. In one embodiment 49 cylinders are arrayed in a row in the X-axis direction for a 305 mm (approximately 12 inch) pad. Similarly, 42 rows of 49 cylinders per row are arrayed in the Y-axis direction for a 305 mm (approximately 12 inch) pad.

Figure 55:
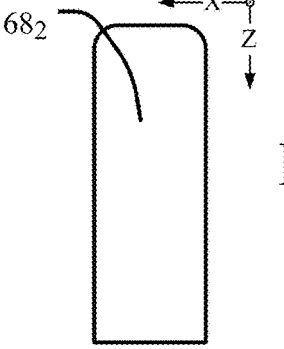
FIG. 55 depicts a front view of the microfiber cylinder of FIG. 53.

In FIG. 55, a front view of the microfiber cylinder $\mathbf{68}_2$ of FIG. 53 is shown. The cylinder $\mathbf{68}_2$ has a height of approximately 17 mm.

Figure 56:
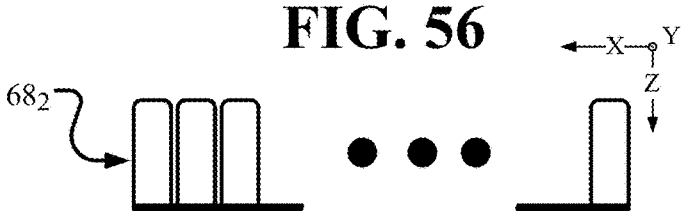
FIG. 56 depicts a front view of the microfiber cylinders of the FIG. 55 size arrayed with a row spacing $\beta 2$ as shown in FIG. 54.

In FIG. 56, a front view of the microfiber cylinders $\mathbf{68}_2$ of the FIG. 53 are arrayed with a row spacing β2 as shown in FIG. 54. In the embodiment, 49 cylinders are arrayed in a row in the X-axis direction for a 305 mm (approximately 12 inch) pad. Similarly, 42 rows of 49 cylinders per row are arrayed in the Y-axis direction for a 305 mm (approximately 12 inch) pad. A typical pad using the FIG. 53 through FIG. 56 material, measures 10 inches in the X-axis direction and 9 inches in the Y-axis direction and has 29 cylinders (tuffs) in the X-axis direction and has 37 cylinders (tuffs) in the Y-axis direction. The density of one embodiment of such a pad was 4.67 ounces per square foot before the backing layer such as a layer 147 in FIG. 47 was attached.

Figure 57:
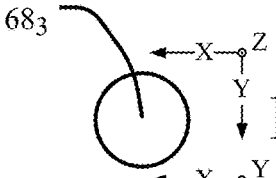
FIG. 57 depicts a top view of another typical microfiber cylinder.

In FIG. 57, a top view of one typical microfiber cylinder $\mathbf{68}_3$ is shown. The cylinder $\mathbf{68}_3$ has a diameter of approximately 5.0 mm.

Figure 58:
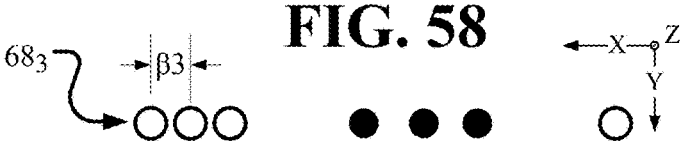
FIG. 58 depicts a row of microfiber cylinders of the FIG. 57 size arrayed with a spacing $\beta 3$.

In FIG. 58, a row of microfiber cylinders $\mathbf{68}_3$ of the FIG. 57 size are arrayed with a row spacing β3 between cylinders $\mathbf{68}_3$. In one embodiment 49 cylinders are arrayed in a row in the X-axis direction for a 305 mm (approximately 12 inch) pad. Similarly, 42 rows of 49 cylinders per row are arrayed in the Y-axis direction for a 305 mm (approximately 12 inch) pad.

Figure 59:
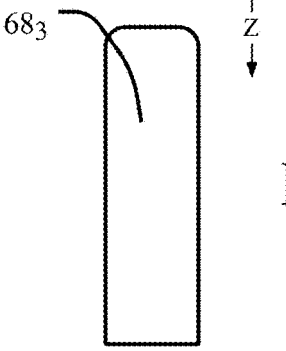
FIG. 59 depicts a front view of the microfiber cylinder of FIG. 57.

In FIG. 59, a front view of the microfiber cylinder $\mathbf{68}_3$ of FIG. 57 is shown. The cylinder $\mathbf{68}_3$ has a height of approximately 17 mm.

Figure 60:
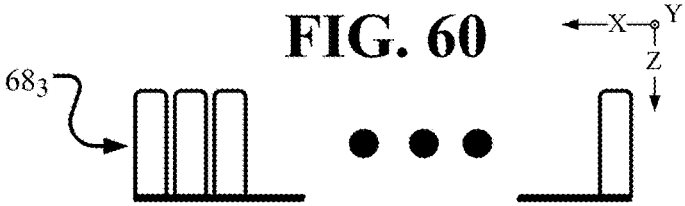
FIG. 60 depicts a front view of the microfiber cylinders of the FIG. 59 size arrayed with a row spacing $\beta 3$ as shown in FIG. 58.

In FIG. 60, a front view of the microfiber cylinders $\mathbf{68}_3$ of the FIG. 53 size are arrayed with a row spacing β3 as shown in FIG. 58. In the embodiment, 49 cylinders are arrayed in a row in the X-axis direction for a 305 mm (approximately 12 inch) pad. Similarly, 42 rows of 49 cylinders per row are arrayed in the Y-axis direction for a 305 mm (approximately 12 inch) pad. A typical pad using the FIG. 57 through FIG. 60 material, measures 10 inches in the X-axis direction and 9 inches in the Y-axis direction and has 30 cylinders (tuffs) in the X-axis direction and has 31 cylinders (tuffs) in the Y-axis direction. The density of one embodiment of such a pad was 3.74 ounces per square foot before the backing layer such as a layer 147 in FIG. 47 was attached.

Figure 61:
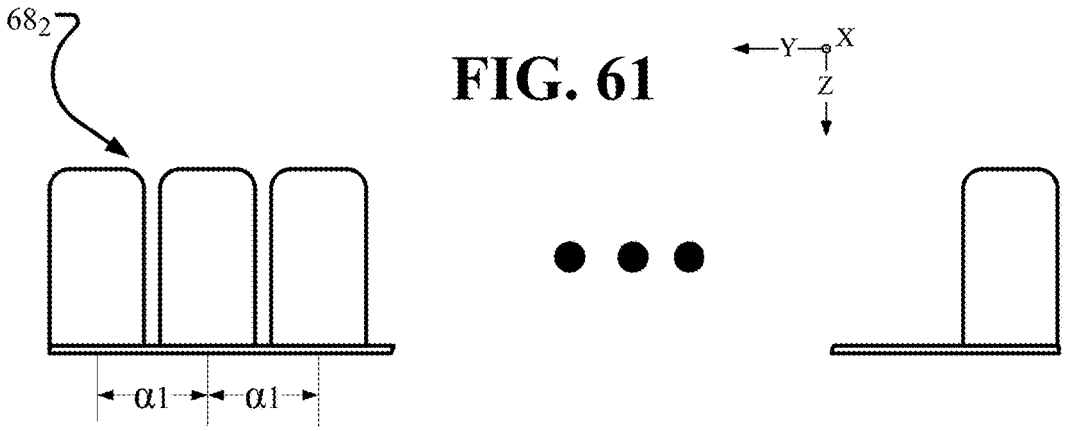
FIG. 61 depicts a front view of the microfiber cylinders of the FIG. 53 and FIG. 54 size arrayed with a column spacing $\alpha 1$.

In FIG. 61, a front view of the microfiber cylinders $\mathbf{68}_2$ of the FIG. 53 and FIG. 54 size are shown arrayed with a column spacing α2 and positioned in the Z-axis direction normal to the XY-plane.

Figure 62:
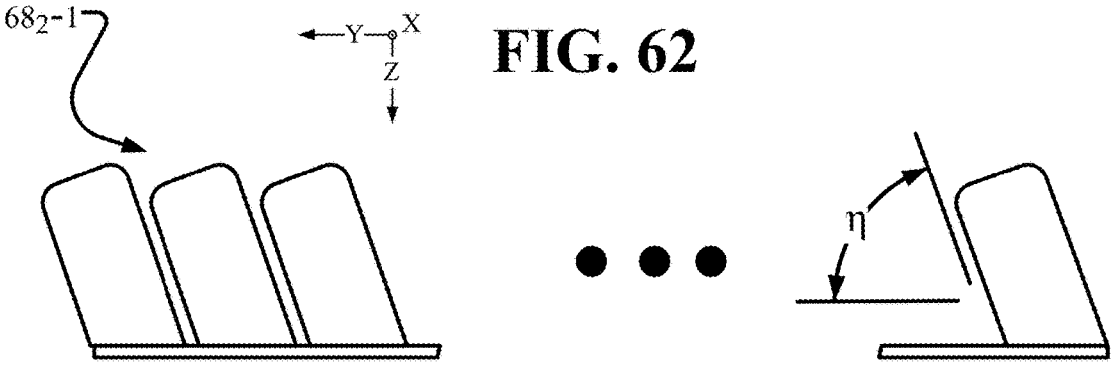
FIG. 62 depicts a front view of the microfiber cylinders of FIG. 61 with an incline angle of $+\eta$.

In FIG. 62, a front view of the microfiber cylinders $\mathbf{68}_2$ of the FIG. 53 and FIG. 54 are shown with an incline angle of +η to the XY-plane and inclining in the positive Y-axis direction.

Figure 63:
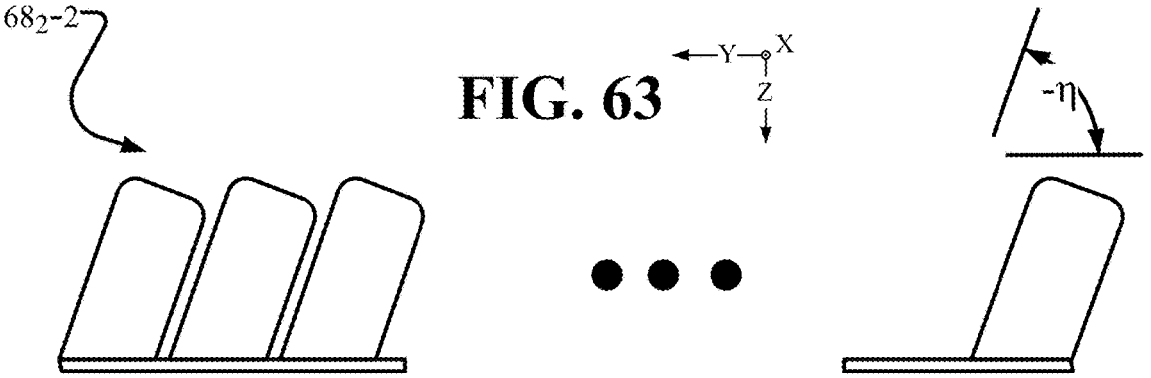
FIG. 63 depicts a front view of the microfiber cylinders of FIG. 61 with an incline angle of $-\eta$.

In FIG. 63, a front view of the microfiber cylinders $\mathbf{68}_2$ of the FIG. 53 and FIG. 54 are shown with an incline angle of −η to the XY-plane and in inclining in the negative Y-axis direction.

In the embodiment of a cleaning pad of the FIG. 49 through FIG. 52 type, typical forces in the machine of the FIG. 13 type that are generated or required are set forth in the following TABLE 1—Tightly Packed Chenille. The forces were measured with the handle latched in the upright position, perpendicular to the XY-plane. In the table, those forces in parenthesis, "( )", indicate that the driving forces generate by the machine are inadequate to move the machine. An additional force is provided by pushing on the handle, such as the force $V_h$ of FIG. 39.

In the following table, the force required to flip Chenille from the forward direction to the reverse direction is (1.60 Kg) when the machine is OFF and Dry and the force required to flip Chenille from forward direction to the reverse is (2.70 Kg) when the machine is OFF and Wet. The flipping of direction is the change from the direction in FIG. 63 to the direction in FIG. 62 of the Chenille cylinders 68. A flipping of direction occurs, for example when an operator is cleaning a floor by having the machine advance in the positive Y-axis direction (pushing the machine forward) and then reversing the machine to advance in the negative Y-axis direction (pulling the machine backward).

In the following table, two surfaces are compared, namely, a Flat Industrial Carpet (FIC) surface and a medium smooth Ceramic Tile (CT) surface. The surfaces are compared for Wet and Dry conditions and with the machine ON and OFF. The Flat Industrial Carpet (FIC) surface is compared for forward motion (+Y-axis direction) both with and against the carpet nap and for reverse motion (−Y-axis direction) both with and against the carpet nap. The term "Reverse" in the table indicates the reverse driving force with the chenille flipped. From TABLE 1, it is apparent that when the machine is ON and the chenille is properly aligned, the machine drives itself without need for any push from a machine operator. Only in the case of a Dry carpet, against the Nap and with the chenille flipped is a force of 0.2 Kg required by an operator to move the machine.

TABLE 1

| Tightly Packed Chenille | | | | |
|---|---|---|---|---|
| | ON | | OFF | |
| SURFACE TYPE | DRY | WET | DRY | WET |
| FIC: With Nap | 0.98 Kg | 1.20 Kg | (3.30 Kg) | (3.58 Kg) |
| FIC: Against Nap | 0.95 Kg | 0.98 Kg | (3.78 Kg) | (3.65 Kg) |
| FIC: With Nap Reverse | 0.36 Kg | 0.72 Kg | | |
| FIC: Against Nap Reverse | (0.13 Kg) | (0.38 Kg) | | |
| CT: | 0.87 Kg | 1.19 Kg | (2.20 Kg) | (3.35 Kg) |

In the embodiment of a cleaning pad of the FIG. 53 through FIG. 56 type, typical forces in the machine of the FIG. 13 type that are generated or required are set forth in the following TABLE 2—Medium Packed Chenille. The forces were measured with the handle latched in the upright position, perpendicular to the XY-plane. In the table, those forces in parenthesis, "( )", indicate that the driving forces generate by the machine are inadequate to move the machine. An additional force is provided by pushing on the handle, such as the force $V_h$ of FIG. 39.

In the following table, two surfaces are compared, namely, a Flat Industrial Carpet (FIC) surface and a medium smooth Ceramic Tile (CT) surface. The surfaces are compared for Wet and Dry conditions and with the machine ON. The Flat Industrial Carpet (FIC) surface is compared for forward motion (+Y-axis direction) both with and against the carpet nap and for reverse motion (−Y-axis direction) both with and against the carpet nap. The term "Reverse" in the table indicates the reverse driving force with the chenille flipped. From TABLE 2, it is apparent that when the machine is ON and the chenille is properly aligned, the machine drives itself without need for any push from a machine operator. Only in the case of a Dry and Wet carpet, against and with the Nap and with the chenille flipped are forces of (0.2 Kg) and (0.15 Kg), respectively, required by an operator to move the machine.

TABLE 2

| Medium Packed Chenille | | |
|---|---|---|
| | ON | |
| SURFACE TYPE | DRY | WET |
| FIC: With Nap | 0.87 Kg | 1.00 Kg |
| FIC: Against Nap | 0.82 Kg | 0.88 Kg |
| FIC: With Nap Reverse | 0.24 Kg | 0.56 Kg |
| FIC: Against Nap Reverse | (0.20 Kg) | (0.15 Kg) |
| CT: | 0.75 Kg | 0.92 Kg |

In the embodiment of a cleaning pad of the FIG. 57 through FIG. 60 type, typical forces in the machine of the FIG. 13 type that are generated or required are set forth in the following TABLE 3—Loosely Packed Chenille. The forces were measured with the handle latched in the upright position, perpendicular to the XY-plane. In the table, those forces in parenthesis, "( )", indicate that the driving forces generate by the machine are inadequate to move the machine. An additional force is provided by pushing on the handle, such as the force $V_h$ of FIG. 39.

In the following table, two surfaces are compared, namely, a Flat Industrial Carpet (FIC) surface and a medium smooth Ceramic Tile (CT) surface. The surfaces are compared for Wet and Dry conditions and with the machine ON and OFF. The Flat Industrial Carpet (FIC) surface is compared for forward motion (+Y-axis direction) both with and against the carpet nap and for reverse motion (−Y-axis direction) both with and against the carpet nap. The term "Reverse" in the table indicates the reverse driving force with the chenille flipped. From TABLE 3, it is apparent that when the machine is ON and the chenille is properly aligned, the machine drives itself without need for any push from a machine operator. Only in the case of a Dry carpet, against the Nap and with the chenille flipped is a force of 0.2 Kg required by an operator to move the machine.

TABLE 3

| Loosely Packed Chenille | | | | |
|---|---|---|---|---|
| | ON | | OFF | |
| SURFACE TYPE | DRY | WET | DRY | WET |
| FIC: With Nap | 0.42 Kg | 0.32 Kg | (3.20 Kg) | (3.10 Kg) |
| FIC: Against Nap | 0.38 Kg | 0.28 Kg | (3.88 Kg) | (3.65 Kg) |
| FIC: With Nap Reverse | (1.10) Kg | (0.62 Kg) | | |
| FIC: Against Nap Reverse | (1.65 Kg) | (1.12 Kg) | | |
| CT: | 0.80 Kg | 0.60 Kg | (2.25 Kg) | (2.85 Kg) |

In an embodiment of a cleaning pad of a Nylon/Cotton/Nylon composition, the typical forces in the machine of the FIG. 13 type that are generated or required are set forth in the following TABLE 4—Nylon/Cotton/Nylon. The forces were measured with the handle latched in the upright position, perpendicular to the XY-plane. In the table, those forces in parenthesis, "( )", indicate that the driving forces generate by the machine are inadequate to move the machine. An additional force is provided by pushing on the handle, such as the force $V_h$ of FIG. 39.

In the following Table 4, two surfaces are compared, namely, a Flat Industrial Carpet (FIC) surface and a medium smooth Ceramic Tile (CT) surface. The surfaces are compared for Wet and Dry conditions with the machine ON. The Flat Industrial Carpet (FIC) surface is compared for forward motion (+Y-axis direction) both with and against the carpet nap. From TABLE 3, it is apparent that when the machine is ON, the machine drives itself without need for any push from a machine operator.

TABLE 4

| Nylon/Cotton/Nylon | | |
|---|---|---|
| | ON | |
| SURFACE TYPE | DRY | WET |
| FIC: With Nap | 1.73 Kg | 0.95 Kg |
| FIC: Against Nap | 1.26 Kg | 0.65 Kg |
| CT: | 1.50 Kg | 1.00 Kg |
| CT: | 1.22 Kg | 0.61 Kg |

In the embodiment of Smooth ABS Plastic substituted for a cleaning pad, typical forces in the machine of the FIG. 13 type that are generated or required are set forth in the following TABLE 5—Smooth ABS Plastic. The forces were measured with the handle latched in the upright position, perpendicular to the XY-plane. In the table, those forces in parenthesis, "( )", indicate that the driving forces generate by the machine are inadequate to move the machine. An additional force is provided by pushing on the handle, such as the force $V_h$ of FIG. 39.

In the following Table 5, two surfaces are compared, namely, a Flat Industrial Carpet (FIC) surface and a medium smooth Ceramic Tile (CT) surface. The surfaces are compared for a Dry condition with the machine ON and OFF. The Flat Industrial Carpet (FIC) surface is compared for forward motion (+Y-axis direction) both with and against the carpet Nap. From TABLE 5, it is apparent that when the machine is ON, the machine drives itself without need for any push from a machine operator. When the machine is OFF, additional force is required to move the machine.

TABLE 5

| Smooth ABS Plastic | | |
|---|---|---|
| SURFACE TYPE | ON DRY | OFF DRY |
| FIC: With Nap | 1.75 Kg | (2.50 Kg) |
| FIC: Against Nap | 1.35 Kg | (2.55 Kg) |
| CT: | 1.76 Kg | (1.60 Kg) |

In the embodiment of a cleaning pad of the FIG. 38 type, typical forces in the machine of the FIG. 13 type that are generated or required are set forth in the following TABLE 6—Shingles. The forces were measured with the handle latched in the upright position, perpendicular to the XY-plane. In the table, those forces in parenthesis, "( )", indicate that the driving forces generate by the machine are inadequate to move the machine. An additional force is provided by pushing on the handle, such as the force $V_h$ of FIG. 39.

In the following table, two surfaces are compared, namely, a Flat Industrial Carpet (FIC) surface and a medium smooth Ceramic Tile (CT) surface. The surfaces are compared for Dry conditions and with the machine ON and OFF. The Flat Industrial Carpet (FIC) surface is compared for forward motion (+Y-axis direction) both with and against the carpet Nap. From TABLE 6, it is apparent that when the machine is ON, the machine drives itself without need for any push from a machine operator. When the machine is OFF, additional force is required to move the machine.

TABLE 6

| Shingles | | | | |
|---|---|---|---|---|
| | ON | | OFF | |
| SURFACE TYPE | DRY | DRY | DRY | DRY |
| FIC: With Nap | 2.60 Kg | 2.27 Kg | | |
| FIC: Against Nap | 1.42 Kg | 0.00 Kg | | (3.40 Kg) |
| CT: | 2.03 Kg | 0.60 Kg | (2.70 Kg) | (3.00 Kg) |

The machine for treating a surface of the present invention may have many different embodiments of which the embodiments of the following TABLE 7 are typical example.

TABLE 7

| | Machine Type | Cleaning Plate (inches × inches) | Weight (Pounds) | Area/ Weight (Inch$^2$/ Pound) |
|---|---|---|---|---|
| A | Hand held upholstery cleaner | 5 × 9 (Att 7 × 12) | 5 | 10.8 to 16.8 |

TABLE 7-continued

| | Machine Type | Cleaning Plate (inches × inches) | Weight (Pounds) | Area/ Weight (Inch$^2$/ Pound) |
|---|---|---|---|---|
| B | Small store mop (for example, small Starbucks ® or ice cream store with primarily hard surface floor) | 5.5 × 18.2 | 12 | 8.3 |
| C | Motel/hotel maids cart machine (Carpet emphasis) | 7 × 11 | 8 | 9.6 |
| D | Mid to large size store (Starbucks ®, McDonalds ® etc. with hard surface floor emphasis) | 6.5 × 24 (Att 6.5 × 30) | 18 | 8.3 |
| E | Hotel hallway & banquet room cleaner | 12 × 24 (Att 12 × 30) | 40 to 90 | Sm. 3.6 to 7.2 Lg. 4.5 to 9 |
| F | Supermarket cleaner | 12 × 30 (Att 12 × 40) | 50 to 140 | Sm. 3.43 to 7.2 Lg. 3.43 to 9.0 |

In TABLE 7, the Machine Type varies from small to large depending on the different applications. Typical Cleaning Plate sizes vary from 7 by 12 inches to 12 by 40 inches without attachments. With attachments ("Att"), the sizes of the cleaning plates for the A, D, E and F machines are increased to 7 inches by 12 inches, 6.5 inches by 30 inches, 12 inches by 30 inches and 12 inches by 40 inches, respectively. Attachments are larger attachment plates attached to the cleaning plate providing a new cleaning plate of a larger size. Typically a loop and hook connection can be used to make the attachment of the smaller plate (or the cleaning plate) to the larger plate. The weights of the machines vary typically from about 5 lb. to 140 lb. The area/weight ratio typically varies from about 17 in$^2$/lb. to 3 in$^2$/lb.

While the invention has been particularly shown and described with reference to preferred embodiments thereof it will be understood by those skilled in the art that various changes in form and details may be made therein without departing from the scope of the invention.

The invention claimed is:

1. A machine for treating a surface lying in an XY plane comprising, a body having a body plate, a cleaning plate located between the body plate and the XY plane, a cleaning pad attached to the cleaning plate, a drive assembly connected to the cleaning plate to drive the cleaning plate and cleaning pad with a cleaning vibration in an oscillating pattern parallel to the XY plane, the oscillating pattern generating a drive force for driving the cleaning plate over the XY-plane in a direction of travel, wherein the drive assembly includes, a first motor apparatus having, a first stator fixed to the cleaning plate, a first rotor for rotating in a first direction about the first stator and about a first motor axis, a first offset weight attached to the first rotor and rotated by the first rotor around the first motor axis whereby the cleaning plate is driven with a first vibration in a first oscillating pattern parallel to the XY plane, a second motor apparatus having, a second stator fixed to the cleaning plate, a second rotor for rotating in a second direction about the second stator and about a second motor axis, a second offset weight attached to the second rotor and rotated by the second rotor around the second motor axis whereby the cleaning plate is driven with a second vibration in a second oscillating pattern parallel to the XY plane, whereby the cleaning plate has a combined vibration formed by the combination of the first vibration and the second vibration for driving the cleaning plate over the XY-plane in the direction of travel, an attachment assembly for flexibly attaching the cleaning plate to the body plate to permit the cleaning plate to vibrate relative to the body plate and to isolate the cleaning vibration from the body.

2. The machine of claim 1 wherein the cleaning vibration is in a range from 1 mm to 5 mm.

3. The machine of claim 1 wherein the first motor and the second motor each rotate in a range from 1700 to 5000 revolutions per minute.

4. The machine of claim 1 wherein the attachment assembly includes, a plurality of compression devices connected between the cleaning plate and the body for urging the cleaning plate and the body toward each other, a plurality of rolling separators under pressure from the compression devices for separating the cleaning plate and the body plate.

5. The machine of claim 1 wherein the motors are DC motors.

6. The machine of claim 5 further including a battery for supplying power to the DC motors.

7. The machine of claim 1 wherein the cleaning pad has a plurality of protrusions.

8. The machine of claim 7 wherein the protrusions are aligned at angles in the direction of travel of the machine.

9. The machine of claim 7 wherein the protrusions are formed of micro-fiber polyester cylinders.

10. The machine of claim 9 wherein the cylinders have a height in the range of from 10 mm to 25 mm.

11. The machine of claim 10 wherein the protrusions have a density in the range of from 3 ounces to 6 ounces per square foot.

12. The machine of claim 1 wherein the body includes a handle whereby a user can move the machine over a floor lying in the XY plane, where the handle is rotationally attached to the body, where the body has a height above the XY-plane, where when the handle is rotated toward the XY-plane, the handle does not exceed the height of the body above the XY-plane.

13. The machine of claim 1 including, a connection device having one side for connecting to the cleaning plate and having another side for connecting to the cleaning pad.

14. A machine for treating a surface lying in an XY plane comprising, a body having a body plate, a cleaning plate located between the body plate and the XY plane, a drive assembly connected to the cleaning plate to drive the cleaning plate with a cleaning vibration in an oscillating pattern parallel to the XY plane wherein the drive assembly includes, a first motor apparatus having, a first stator fixed to the cleaning plate, a first rotor for rotating in a first direction about the first stator and about a first motor axis, a first offset weight attached to the first rotor and rotated by the first rotor around the first motor axis whereby the cleaning plate is driven with a first vibration in a first oscillating pattern parallel to the XY plane, a second motor apparatus having, a second stator fixed to the cleaning plate, a second rotor for rotating in a second direction about the second stator and about a second motor axis, a second offset weight attached to the second rotor and rotated by the second rotor around the second motor axis whereby the cleaning plate is driven with a second vibration in a second oscillating pattern parallel to the XY plane, whereby the cleaning plate has the cleaning vibration formed by the combination of the first vibration and the second vibration for driving the cleaning plate over the XY-plane in a direction of travel, an attachment assembly for flexibly attaching the cleaning plate to the body plate under compression to permit the cleaning plate to vibrate relative to the body plate and to isolate the cleaning vibration from the body, a connector attached to the body for receiving a member to move the machine in the XY plane.

15. The machine of claim 14 wherein the attachment assembly includes, a plurality of compression devices connected between the cleaning plate and the body for urging the cleaning plate and the body toward each other, a plurality of rolling separators under pressure from the compression devices for separating the cleaning plate and the body plate.

16. The machine of claim 14 wherein the machine has a cleaning pad attached to the cleaning plate and has a weight in the range from about 5 pounds to 17 pounds and wherein the ratio of area of the cleaning pad to the weight of the machine is in the range of about 17 $in^2/lb$ to 3 $in^2/lb$.

* * * * *